US010399805B2

(12) United States Patent
Shiina et al.

(10) Patent No.: US 10,399,805 B2
(45) Date of Patent: Sep. 3, 2019

(54) SHEET CONVEYANCE APPARATUS

(71) Applicant: CANON KABUSHIKI KAISHA, Tokyo (JP)

(72) Inventors: Sachiyori Shiina, Mishima (JP); Takashi Yano, Mishima (JP); Kazuhide Okuno, Mishima (JP); Yohei Suzuki, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 555 days.

(21) Appl. No.: 14/989,970

(22) Filed: Jan. 7, 2016

(65) Prior Publication Data

US 2016/0200535 A1 Jul. 14, 2016

(30) Foreign Application Priority Data

Jan. 9, 2015 (JP) ..... 2015-003400
Dec. 3, 2015 (JP) ..... 2015-236251

(51) Int. Cl.

*B65H 7/20* (2006.01)
*B65H 5/06* (2006.01)
*G03G 15/00* (2006.01)

(52) U.S. Cl.

CPC ..... *B65H 7/20* (2013.01); *B65H 5/062* (2013.01); *G03G 15/6529* (2013.01); *G03G 2215/00721* (2013.01)

(58) Field of Classification Search

CPC ... B65H 7/00; B65H 7/02; B65H 7/04; B65H 7/06; B65H 7/08; B65H 7/10; B65H 7/12; B65H 7/125; B65H 7/14; B65H 7/16; B65H 7/18; B65H 7/20

See application file for complete search history.

(56) References Cited

U.S. PATENT DOCUMENTS 5,043,763 A 8/1991 Koh et al.
5,153,655 A 10/1992 Suzuki et al.
5,157,444 A 10/1992 Mori et al.
5,923,140 A * 7/1999 Azumi ..... B65H 7/02 318/560
6,113,093 A 9/2000 Morinaga et al.

(Continued)

FOREIGN PATENT DOCUMENTS

JP 2008-001465 A 1/2008
JP 2012-144350 A 8/2012

*Primary Examiner* — Thomas A Morrison
(74) *Attorney, Agent, or Firm* — Venable LLP

(57) ABSTRACT

A sheet conveyance apparatus includes a conveyance portion to convey a sheet in a sheet conveyance direction, and a moving member having a main body portion, a contact portion configured to come into contact with the sheet conveyed by the conveyance portion, and a shaft portion provided on the main body portion, with the moving member configured to be moved due to the contact portion contacting the sheet. A first support portion pivotably supports a first part of the shaft portion such that the moving member is configured to pivot around the shaft, and a second support portion pivotably and slidably supports a second part of the shaft portion such that the second part of the shaft portion swings around the first part. In addition, a biasing member biases the moving member, and a sensor transmits a signal according to a position of the moving member.

8 Claims, 22 Drawing Sheets

(56) References Cited

U.S. PATENT DOCUMENTS

| | | | | |
|---|---|---|---|---|
| 6,382,622 | B1 | 5/2002 | Takada et al. | |
| 6,385,406 | B1 | 5/2002 | Funamizu et al. | |
| 6,826,383 | B2 | 11/2004 | Yano | |
| 6,988,727 | B2 | 1/2006 | Yano | |
| 8,317,193 | B2 | 11/2012 | Yano | |
| 8,528,899 | B2 | 9/2013 | Suzuki | |
| 8,556,259 | B2 | 10/2013 | Suzuki | |
| 8,849,178 | B2 | 9/2014 | Yoshimura et al. | |
| 8,910,938 | B2 * | 12/2014 | Sunohara | B65H 43/02 271/258.01 |
| 9,033,334 | B2 | 5/2015 | Yano | |
| 2014/0361482 | A1 * | 12/2014 | Iizuka | B65H 7/08 271/111 |
| 2015/0042038 | A1 * | 2/2015 | Shiina | B65H 7/14 271/265.01 |

* cited by examiner

SHEET CONVEYANCE APPARATUS

BACKGROUND OF THE INVENTION

Field of the Invention

This disclosure relates to a sheet conveyance apparatus conveying sheets.

Description of the Related Art

Hitherto, an image forming apparatus such as a copier, a printer, or a facsimile is provided with a sheet conveyance apparatus conveying sheets. The sheet conveyance apparatus conveys a sheet to an image forming portion, and a toner image formed on a photoconductive drum is transferred onto the sheet. The sheet onto which the toner image has been transferred is conveyed to a fixing portion and is then conveyed to a discharging portion. In recent years, in an image forming apparatus, there has been an increasing demand for further improvement in productivity, that is, improvement in the number of sheets on which images are formed per unit time.

For this reason, a sheet conveying speed has been attempted to be increased, or an interval (hereinafter, referred to as a sheet interval) from a rear end of a continuously conveyed sheet to a front end of the next sheet has been attempted to be reduced. It is noted that, in an image reading apparatus reading an image formed on a sheet (document) by using an image reading portion, a sheet interval has been attempted to be reduced.

Meanwhile, in a certain conventional sheet conveyance apparatus, when a sheet is conveyed, switching operations in various switch members, an operation of switching a direction of rotation of a sheet conveying portion, or the like is performed on the basis of detection of a sheet front end. In order to detect a front end of a sheet, a sheet detection portion detecting a front end of a sheet is provided on a sheet conveyance path.

Here, as the sheet detection portion, there is one including an abutting member which abuts on a front end of a sheet and pivots, and a detection sensor which detects the pivoting abutting member and outputs a detection signal to a control portion. In such a sheet detection portion, if the abutting member pressed by a sheet is moved (changed) from a non-detection position (non-detection state) to a detection position (detection state) where the detection sensor can perform detection, the detection sensor detecting the movement outputs a detection signal to the control portion.

If the detection signal is input, the control portion determines that the conveyed sheet has reached the sheet conveyance path. Thereafter, if the sheet passes through the abutting member, and the abutting member returns from the detection position to the original non-detection position as a result of the pressing from the sheet being released, a detection signal is not output from the detection sensor, and thus the detection signal is not input to the control portion any longer. Thus, the control portion determines that the sheet has passed through the sheet conveyance path.

However, in the case where the sheet detection portion has such a configuration, since some time is required for the abutting member to return from the detection position to the non-detection position, passage of a sheet cannot be detected if a sheet interval is shortened.

Therefore, JP-A-2008-1465 discloses a sheet conveyance apparatus in which a pivotal shaft of an abutting member is obliquely inclined with respect to a direction of sheet conveyance when viewed from a normal direction of a sheet surface. As a result of the pivotal shaft of the abutting member being obliquely inclined, a falling amount of the sensor in the direction of sheet conveyance is reduced during passage of the sheet, that is, when the sensor starts operation, and thus it is possible to reduce a mechanical loss until the abutting member returns from the detection position to the non-detection position.

JP-A-2012-144350 discloses a sheet conveyance apparatus using a method in which an abutting member returns from a detection position to a non-detection position through rotation thereof instead of a method in which the abutting member is reciprocally moved between the detection position and the non-detection position. It is possible to considerably reduce a mechanical loss by rotating the abutting member once whenever a sheet passes. In the certain conventional sheet conveyance apparatuses, for example, in the case where the pivotal shaft of the abutting member is disposed so as to be obliquely inclined with respect to the direction of sheet conveyance when viewed from the normal direction of a sheet surface, the abutting member starts to return to the non-detection position after a rear end of a sheet passes.

In other words, the abutting member cannot start an operation of returning to the non-detection position before the rear end of the sheet passes. For this reason, even in a case where the abutting member is inclined, a shorter sheet interval cannot be handled. In the case where the abutting member is rotated once whenever a sheet passes, the number of components increases, and a space for rotating the abutting member in the direction of sheet conveyance is necessary. Thus, a size thereof becomes large, and cost increases.

SUMMARY OF THE INVENTION

According to a preferred embodiment of this disclosure, there is provided a sheet conveyance apparatus including a conveyance portion configured to convey a sheet, and a detection portion configured to detect conveyance of the sheet. The detection portion includes a moving member including a main body and a contact portion, provided at the main body and configured to contact the sheet, the moving member configured to be moved due to the contact portion contacting the sheet, a biasing member biasing the contact portion in a predetermined direction, and a sensor transmitting a signal according to a position of the moving member. The moving member is configured to be moved such that the contact portion returns, from a first position, to the first position through a second position and a third position until a single sheet passes through the detection portion. The first position is a position at which the contact portion protrudes inside a conveyance path of the sheet. The second position is a position to which the contact portion is moved in a conveyance direction of the sheet and a direction, of being retracted from the conveyance path, from at the first position. The third position is a position to which the contact portion is moved in an opposite direction to the conveyance direction from the second position. A signal from the sensor in a case where the contact portion is positioned at the first position is different from signals from the sensor in a case where the contact portion is positioned at the second position and the third position. The contact portion at the first position starts contact with a front end portion of the sheet which is being conveyed at the conveyance portion, is moved from the first position to the second position at which the contact with the front end portion of the sheet is released by a pressing force received from the front end portion of the sheet, is moved from the second position to the third position by a biasing force of the biasing member, and is moved from the third position to the first position by the biasing force of the biasing member in a case where a contact with the sheet is released by the sheet passed through the detection portion.

Further features of the present invention will become apparent from the following description of exemplary embodiments with reference to the attached drawings.

DESCRIPTION OF THE EMBODIMENTS

First Embodiment

Figure 1:
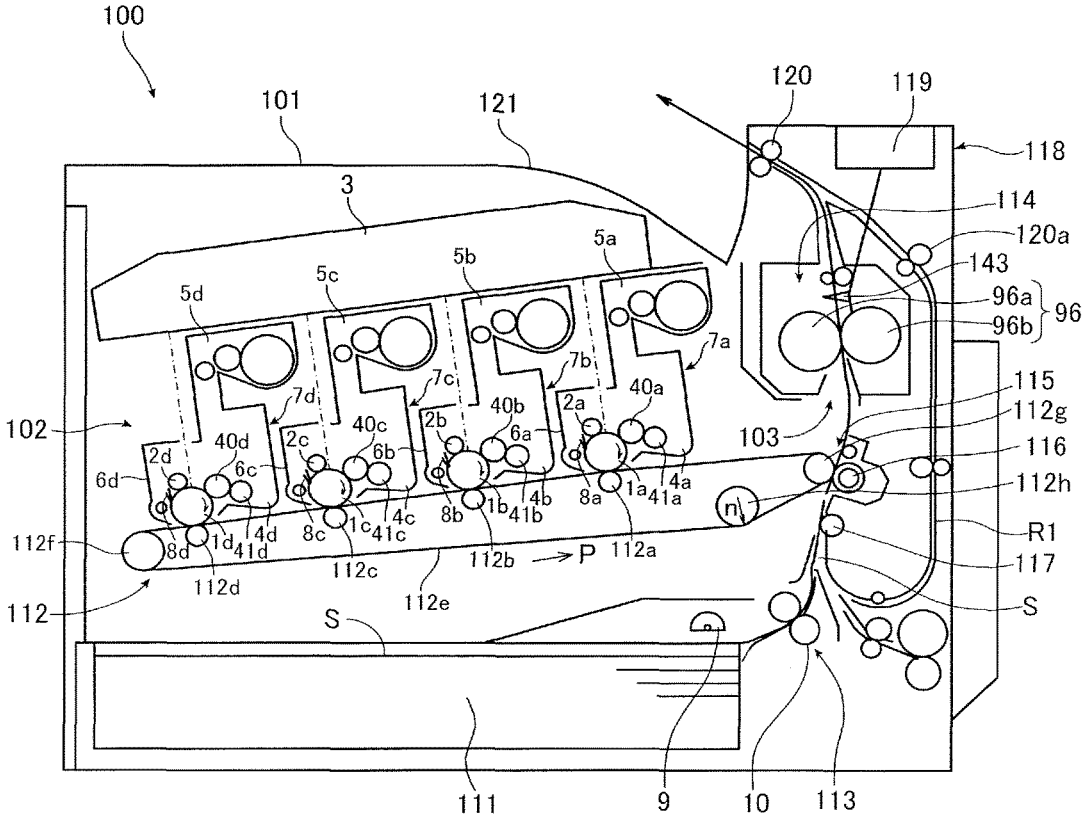
FIG. 1 is the entire configuration diagram illustrating an electrophotographic full-color laser printer which is an example of an image forming apparatus provided with a sheet conveyance apparatus according to a first embodiment of this disclosure.

Hereinafter, embodiments of this disclosure will be described in detail with reference to the drawings. FIG. 1 is the entire configuration diagram illustrating an electrophotographic full-color laser printer which is an example of an image forming apparatus provided with a sheet conveyance apparatus according to a first embodiment of this disclosure. In FIG. 1, the reference numeral 100 indicates a full-color laser printer, and the reference numeral 101 indicates a full-color laser printer body (hereinafter, referred to as a printer body). The printer body 101 which is the image forming apparatus main body is provided with an image forming portion 102 forming an image on a sheet, a sheet feeding device 113 feeding a sheet, a sheet conveyance apparatus 103 conveying the sheet fed from the sheet feeding device 113, and the like.

The image forming portion 102 includes process cartridges 7 (7*a*, 7*b*, 7*c*, and 7*d*) detachably attached to the printer body 101 and forming a toner image in four colors including yellow, magenta, cyan, and black. It is noted that, the process cartridges 7 are constituted of developing units 4 (4*a*, 4*b*, 4*c*, and 4*d*) and toner units 5 (5*a*, 5*b*, 5*c*, and 5*d*). The developing units 4 include photoconductive drums 1 (1*a*, 1*b*, 1*c*, and 1*d*) which are image bearing members, charging rollers 2 (2*a*, 2*b*, 2*c*, and 2*d*), drum cleaning blades 8 (8*a*, 8*b*, 8*c*, and 8*d*), and the like. The developing units 4 include developing rollers 40 (40*a*, 40*b*, 40*c*, and 40*d*) and developer coating rollers 41 (41*a*, 41*b*, 41*c*, and 41*d*).

The image forming portion 102 includes a scanner unit 3 disposed over the process cartridges 7 and applying laser light on the basis of image information so as to form an electrostatic latent image on the photoconductive drums 1. The image forming portion 102 includes an intermediate transfer belt unit 112 provided with intermediate transfer belt 112*e* which is disposed under the process cartridges 7 and onto which respective color toner images on the photoconductive drums are sequentially transferred.

The intermediate transfer belt unit 112 includes primary transfer rollers 112*a*, 112*b*, 112*c* and 112*d* disposed inside the intermediate transfer belt 112*e* in addition to the intermediate transfer belt 112*e* rotated in a counterclockwise direction indicated by an arrow P. It is noted that, the intermediate transfer belt 112*e* is hung on a drive roller 112*f*, a secondary transfer counter roller 112*g*, and a tension roller 112*h*, and receives a tensile force from the tension roller 112*h* in a direction of an arrow n.

The primary transfer rollers 112*a*, 112*b*, 112*c* and 112*d* are disposed to oppose the respective photoconductive drums 1, and transfer biases are applied thereto by a transfer bias apply device (not illustrated). Primary transfer biases are applied by the primary transfer rollers 112*a*, 112*b*, 112*c* and 112*d*, and thus the respective color toner images on the photoconductive drums are sequentially transferred onto the intermediate transfer belt 112*e*. As a result, a full-color image is formed on the intermediate transfer belt. The sheet feeding device 113 includes a sheet feeding cassette 111 attached to the printer body 101 so as to be extracted therefrom, a sheet feed roller 9 feeding a sheet S stored in the sheet feeding cassette 111, and the like.

It is noted that, in FIG. 1, the reference numeral 117 indicates a registration roller pair, and the reference numeral 116 indicates a secondary transfer roller constituting a secondary transfer unit 115 transferring the full-color toner image formed on the intermediate transfer belt 112*e* on the sheet along with the secondary transfer counter roller 112*g*. The reference numeral 114 indicates a fixing portion applying heat and pressure to the toner image which has been transferred onto the sheet by the secondary transfer unit 115 so as to fix the toner image to the sheet. The fixing portion 114 includes a fixing roller pair 96 constituted of a fixing roller 96*a* having a heater (not illustrated) built thereinto and a pressing roller 96*b* coming into pressure contact with the fixing roller 96*a*.

The reference numeral 118 indicates a sheet discharge unit discharging the sheet to which the toner image is fixed in the fixing portion 114 to a discharge sheet stacking unit 121 on the upper surface of the printer body. The sheet discharge unit 118 includes a discharging roller pair 120 which can normally and reversely rotate, a switched back roller pair 120*a*, a reverse conveying path R1, and the like. The sheet conveyance apparatus 103 conveys the sheet S by using the rollers such as the registration roller pair 117, the secondary transfer roller 116, and the fixing roller pair 96, and includes a sheet detection portion 143 which will be described later, and the like. The reference numeral 119 indicates a control portion controlling an image forming operation and a sheet conveying operation.

Next, a description will be made of an image forming operation in the full-color laser printer 100 with the above-described configuration. If an image signal is input from a PC (not illustrated) or the like to the scanner unit 3, the scanner unit 3 irradiates the photoconductive drums with laser light corresponding to the image signal. At this time, surfaces of the photoconductive drums 1 are uniformly charged to a predetermined polarity or potential in advance by the charging rollers 2, and thus electrostatic latent images are formed on the surfaces thereof when the scanner unit 3 irradiates the surfaces thereof with the laser light.

Thereafter, the electrostatic latent images are developed by the developing units 4, and thus toner images with four colors including yellow, magenta, cyan, and black are formed on the photoconductive drums of the respective process cartridges 7. The four-color toner images are sequentially transferred onto the intermediate transfer belt with primary transfer biases applied to the primary transfer rollers 112*a*, 112*b*, 112*c* and 112*d*, and thus a full-color toner image is formed on the intermediate transfer belt. It is noted that, after the toner image is transferred, toner remaining on the photoconductive drum surfaces is removed by the drum cleaning blades 8.

Along with the toner image forming operation, the sheets S stored in the sheet feeding cassette 111 are delivered by the sheet feed roller 9 and are then separated one by one by a separating roller pair 10, and the separated sheet S is conveyed to the registration roller pair 117. Next, the sheet S undergoes timing matching by the registration roller pair 117 and is then conveyed to the secondary transfer unit 115. In the secondary transfer unit 115, a positive polarity bias is applied to the secondary transfer roller 116, and thus the full-color toner image on the intermediate transfer belt is secondarily transferred onto the conveyed sheet S.

After the toner image is transferred, the sheet S is conveyed to the fixing portion 114 so as to be heated and pressed by the fixing roller 96*a* and the pressing roller 96*b*, and thus the toner image is fixed on the surface thereof. Next, after the full-color toner image is fixed, the sheet S is discharged to and stacked on the discharge sheet stacking unit 121 by the discharging roller pair 120 provided in the sheet discharge unit 118. It is noted that, in the case where images are formed on two sides of the sheet, the sheet S passes along the reverse conveying path R1 through reversion of the discharging roller pair 120 and the switched back roller pair 120*a* and is conveyed to the registration roller pair 117 again. Then, the sheet S is conveyed to the secondary transfer unit 115 by the registration roller pair 117, and thus an image is formed on a second surface thereof. A toner image is fixed to the sheet S of which the image is formed on the second surface when passing through the fixing portion 114, and then the sheet S is stacked on the discharge sheet stacking unit 121 by the discharging roller pair 120.

Meanwhile, as illustrated in FIG. 1, the sheet detection portion 143 (detection portion) which is a detection portion detecting the sheet S which is nipped and conveyed by the fixing roller pair 96 is provided on a downstream side of the fixing roller pair 96 which is a conveyance portion in the direction of sheet conveyance. The sheet detection portion 143 is connected to the control portion 119, and the control portion 119 detects the sheet S having passed through the fixing roller pair 96 on the basis of a signal from the sheet detection portion 143. The control portion 119 controls conveyance of the sheet S or performs a notification of jam (sheet jam) on the downstream side of the fixing portion 114 in the direction of sheet conveyance on the basis of the detection information received from the sheet detection portion 143.

Figure 2A:
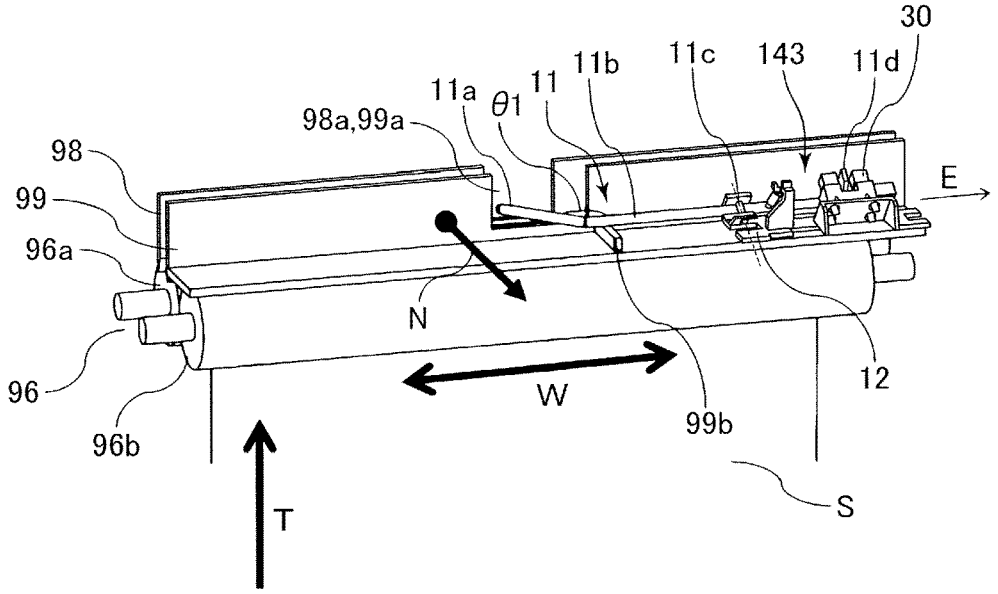
FIG. 2A is a perspective view illustrating a configuration of a sheet detection portion provided in the sheet conveyance apparatus.
Figure 2B:
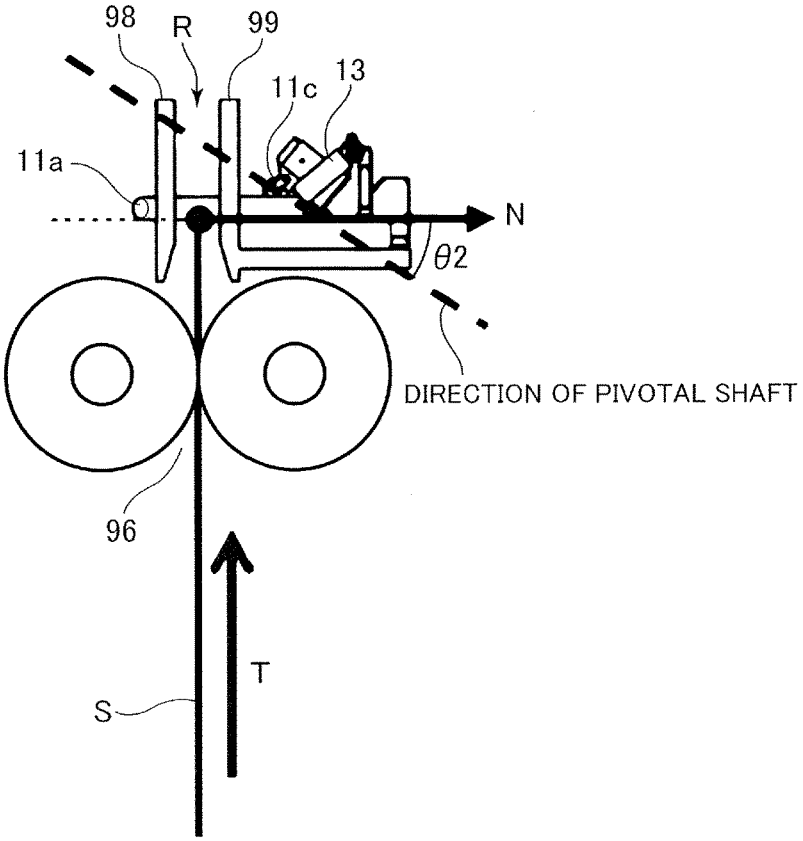
FIG. 2B is a side view illustrating a configuration of the sheet detection portion.

Here, the sheet detection portion 143 includes, as illustrated in FIGS. 2A and 2B, an abutting member (moving member) 11, a light emitting portion and a light receiving portion (not illustrated), and a photo sensor 30 (sensor) detecting the abutting member 11. As illustrated in FIG. 2A, the abutting member 11 includes an arm 11*b* which is a main body disposed in parallel to a width direction W orthogonal to the direction of sheet conveyance, and an abutting portion (contact portion) 11*a* provided at a tip of the arm 11*b* so as to be inclined with a predetermined angle θ1 with respect to the arm 11*b*.

It is noted that, in FIG. 2A, the reference numerals 98 and 99 indicate sheet guides, and the sheet S having passed through the fixing roller pair 96 passes between the sheet guides 98 and 99. It is noted that, openings 98*a* and 99*a* are respectively formed in the sheet guides 98 and 99, and the abutting portion 11*a* of the abutting member 11 is inserted into the openings 98*a* and 99*a* so as to come into contact with the sheet S passing between the sheet guides 98 and 99. The abutting member 11 is supported by a support portion 12 provided at the sheet guide 99, via a pivotal shaft 11*c* which is a shaft portion.

Here, in the present embodiment, the pivotal shaft 11*c* of the abutting member 11 provided at the arm 11*b* is disposed with a predetermined angle θ2 with respect to a normal direction N of a sheet conveyance path R formed by the sheet guides 98 and 99 as illustrated in FIG. 2B. That is, the pivotal shaft 11*c* of the abutting member 11 is disposed in a direction which is not parallel to the width direction. In other words, the pivotal shaft 11*c* is inclined so that a portion thereof close to the conveyance path is located further toward the downstream side in a conveyance direction of the sheet than a portion thereof far from the conveyance path. The abutting member 11 is moved centering on the pivotal shaft 11*c* which is disposed in this state and is a moving center (the center of pivot). A light blocking portion 11*d* is provided at an end of the abutting member 11 opposite side to the abutting portion 11*a* with respect to the pivotal shaft 11*c* as a center, and the photo sensor 30 is supported by the support portion 12 at a position corresponding to the light blocking portion 11*d*.

When the abutting member 11 is in a non-detection state in which the abutting portion 11*a* is located at a standby position so as to abut on the sheet S, if the abutting portion 11*a* is pressed by the conveyed sheet S and is thus swung, an optical path between the light emitting portion and the light receiving portion of the photo sensor 30 is shielded from light by the light blocking portion 11*d*. Consequently, the photo sensor 30 is turned off. In other words, if the abutting member 11 changes from the non-detection state to a detection state, the photo sensor 30 is turned off.

If the sheet S has passed, and thus pressing against the abutting portion 11*a* by the sheet S is released, the abutting member 11 in the detection state detected by the photo sensor 30 returns to the original standby position. Consequently, the light blocking portion 11*d* is retracted from the optical path between the light-emitting portion and the light-receiving portion of the photo sensor 30, and thus the photo sensor 30 is turned on. In other words, if the abutting member 11 changes from the detection state to the non-detection state, the photo sensor 30 is turned on. The control portion 119 determines passage of a front end and a rear end of the sheet on the basis of turning-on and turning-off of the photo sensor 30.

It is noted that, in the present embodiment, the sheet guides 98 and 99 have a linear shape, but, even if the sheet guides 98 and 99 have a curved shape, the sheet detection portion 143 can detect a front end and a rear end of a sheet. Here, in a case where the sheet conveyance path R is curved by the sheet guides 98 and 99 having a curved shape, the normal direction N of the sheet conveyance path R is defined as a normal relative to the sheet conveyance path R at the position of the abutting portion 11*a* of the abutting member 11.

Figure 3:
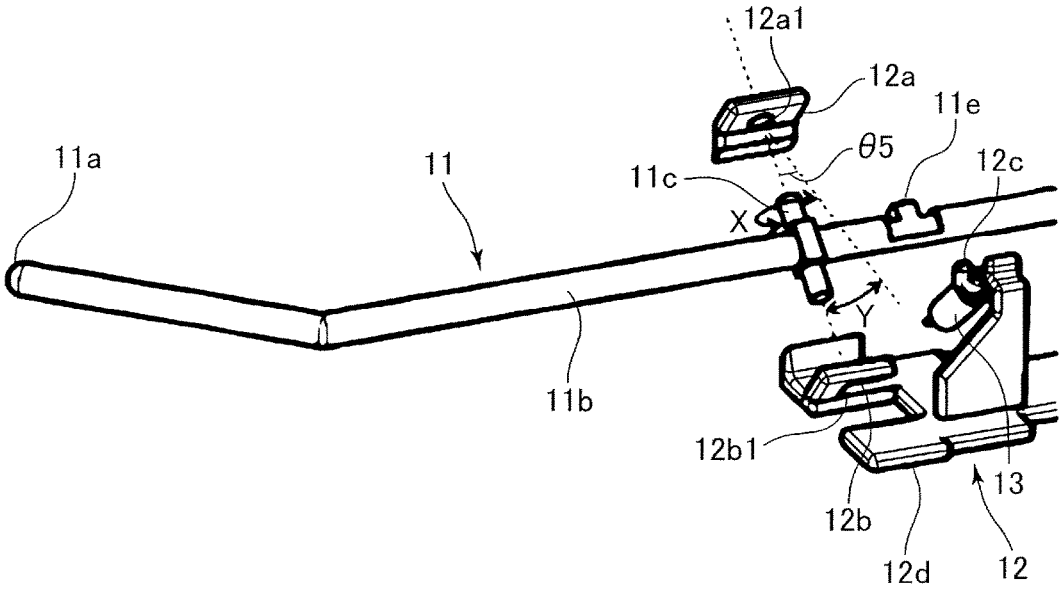
FIG. 3 is an exploded enlarged view illustrating the vicinity of an abutting member of the sheet detection portion.

As illustrated in FIG. 3, the support portion 12 supporting the pivotal shaft 11*c* includes a main body 12*d*, and a support member 12*a* (first support portion) supporting the abutting member 11 via the pivotal shaft 11*c* along with the main body 12*d*. The support member 12*a* is provided with a round hole 12*a*1 into which one end of the pivotal shaft 11*c* is inserted, and the main body 12*d* (second support portion) is provided with a slit-like sliding portion 12*b* to which the other end of the pivotal shaft 11*c* is slidably locked.

Here, the pivotal shaft 11*c* at the support portion 12 is supported by the support portion 12 with the predetermined inclination 82 with respect to the normal direction N of the sheet conveyance path R as described above. In the present embodiment, the pivotal shaft 11*c* is supported by the support portion 12 with a predetermined inclination θ5 with respect to the direction of sheet conveyance, and is movably (slidably) supported along a plane orthogonal to the direction of sheet conveyance and along the slit-like sliding portion 12*b*.

Since the pivotal shaft 11*c* is supported in the above-described way, the abutting member 11 can be moved (swung) in the X direction and in the Y direction along the sliding portion 12*b* with the pivotal shaft 11*c* as a supporting point. In other words, in the present embodiment, the abutting member 11 is supported by the support portion 12 so as to be moved in two-axis directions including the X direction and the Y direction. The abutting member 11 can be moved in the two-axis directions, and thus the abutting portion 11*a* can be separately moved in a direction of sheet conveyance T of the sheet S and the normal direction N of the sheet conveyance path R illustrated in FIG. 2B.

Figure 4A:
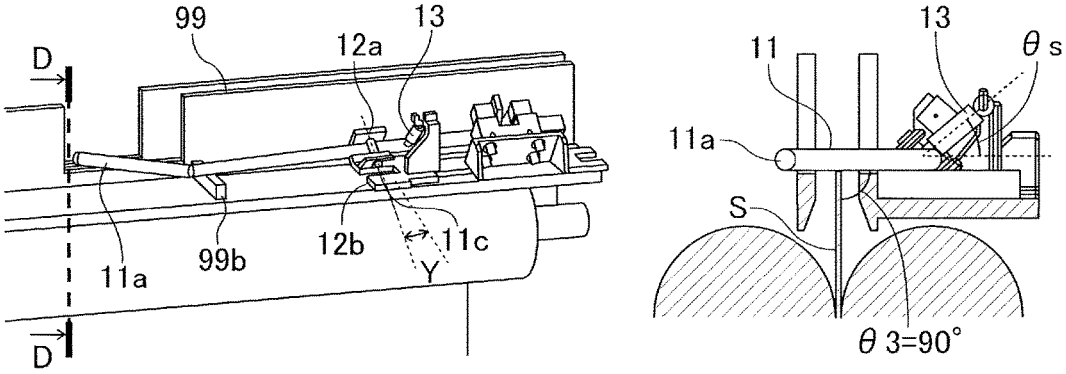
FIG. 4A shows a perspective view and a side view illustrating the sheet detection portion in a state in which an abutting portion is located at a standby position (first position).

It is noted that, as illustrated in FIG. 3, hook shapes 11*e* and 12*c* are respectively formed at the arm 11*b* and the main body 12*d* of the support portion 12, and a tensile spring 13 which is a biasing member biasing the abutting member 11 is hooked to the hook shapes 11*e* and 12*c*. It is noted that, the tensile spring 13 is attached with a predetermined angle $\theta_S$ with respect to the normal direction N of the sheet conveyance path R as illustrated in FIG. 4A to be described later. The abutting member 11 is pulled by the tensile spring 13 and receives a force for returning to the standby position in the X direction and the Y direction with the pivotal shaft 11*c* as a supporting point.

Here, as illustrated in FIG. 2A, an abutting rib 99*b* on which the arm 11*b* of the abutting member 11 abuts is provided at the sheet guide 99. If the abutting member 11 biased by a spring force of the tensile spring 13 is swung centering on the pivotal shaft 11*c*, and thus the arm 11*b* abuts on the abutting rib 99*b*, the abutting member 11 is stopped at the standby position (first position) which is a non-detection position illustrated in FIG. 2A. In this state, the abutting portion 11*a* enters the sheet conveyance path so as to abut on a conveyed sheet. It is noted that, in the present embodiment, the photo sensor 30 is disposed within the width of the fixing roller pair 96, but the photo sensor 30 may be disposed outside the width of the fixing roller pair 96 by further extending the light blocking portion 11*d* in a direction of E in FIG. 2A.

However, in the present embodiment, the arm 11*b* becomes parallel to the width direction orthogonal to the direction of sheet conveyance in a state in which the abutting member 11 is supported by the support portion 12. Typically, it is necessary to reduce a pivotal angle of the abutting member 11 in order to reduce a mechanical loss, and, for this, an arm length is required to be increased in a certain conventional sensor. Thus, a large operation trajectory area is necessary in an apparatus cross-sectional direction. However, in the present embodiment, since the arm 11*b* extends in parallel to the width direction, an operation trajectory required in the sheet detection portion 143 in the apparatus cross-sectional direction can be reduced regardless of the length of the arm. Therefore, the sheet detection portion 143 of the present embodiment can also be mounted in a full-color laser printer (image forming apparatus) in which downsizing and high printing speed are progressing. It is noted that, the arm 11*b* is not necessarily parallel to the width direction. An angle of the arm 11*b* may be adjusted, and the arm 11*b* may be inclined within a predetermined range with respect to the width direction according to an apparatus configuration.

Figure 4B:
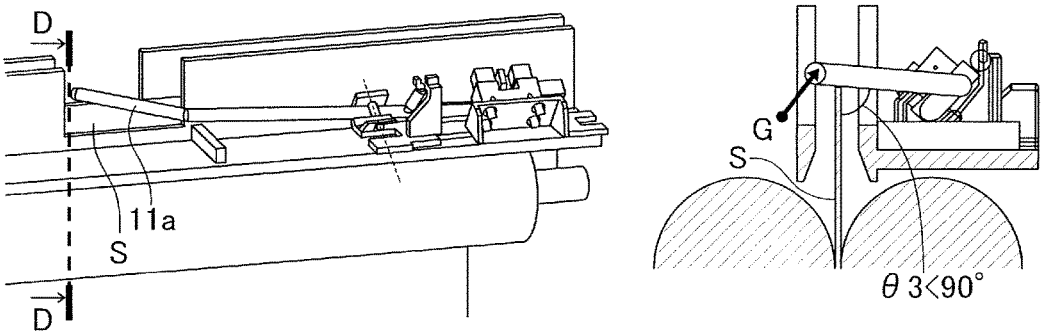
FIG. 4B shows a perspective view and a side view illustrating the sheet detection portion in a state in which a front end of a sheet abuts on the abutting portion.
Figure 4C:
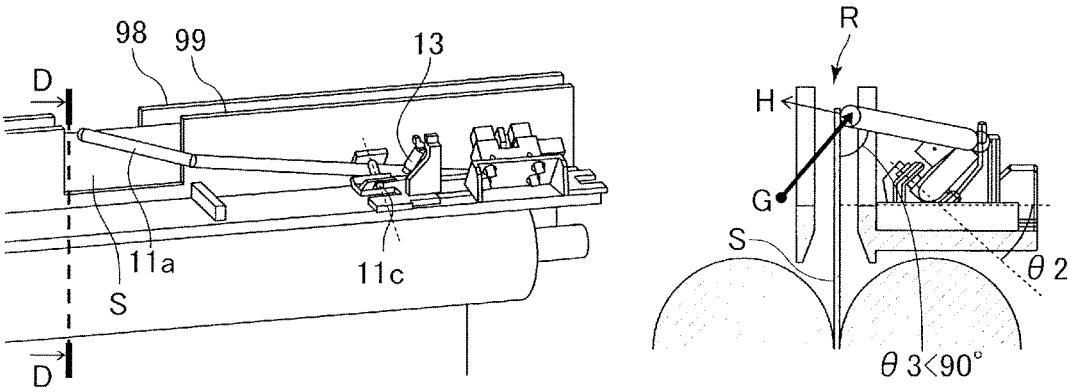
FIG. 4C shows a perspective view and a side view illustrating the sheet detection portion in a state in which the abutting portion is located at a second position.

Next, with reference to FIGS. 4A to 5B, a description will be made of an operation of the sheet detection portion 143 of the present embodiment. It is noted that, each of FIGS. 4A to 4C shows a perspective view in which the sheet detection portion 143 is viewed from the same direction as in FIG. 2A, and a sectional view (a sectional view taken along the line D-D) in which the sheet detection portion 143 is viewed from the axial direction of the fixing roller pair 96 which is the same direction as in FIG. 2B together.

If the sheet S is conveyed into the sheet conveyance path formed between the sheet guides 98 and 99, the front end (direction of sheet conveyance downstream end) of the sheet S abuts on the abutting portion 11*a* of the abutting member 11 protruding inside the sheet conveyance path, and pushes up the abutting portion 11*a*. In this case, as illustrated in FIG. 4A, the sheet front end forms the right angle with the abutting portion 11*a*. Here, as illustrated in FIG. 2A already described above, the abutting portion 11*a* of the abutting member 11 is inclined with the predetermined angle θ1 with respect to the extending direction of the arm 11*b*. The abutting portion 11*a* of the abutting member 11 can be separately moved (swung) along the plane parallel to the direction of sheet conveyance T and the plane parallel to the normal direction N of the sheet conveyance path R.

Consequently, if the sheet S abuts on the abutting portion 11*a* with an abutting angle of 90°, a force is applied to the abutting portion 11*a* by the sheet S in the direction of sheet conveyance. In other words, a force in a direction perpendicular to the direction of sheet conveyance is applied to the abutting member 11. Consequently, the abutting member 11 starts being swung in the X direction illustrated in FIG. 3. It is noted that, the tensile spring 13 is locked with an angle of θs with respect to the normal direction N of the sheet conveyance path R as illustrated in FIG. 4A.

When the abutting member 11 is located at the standby position, the pivotal shaft 11*c* of the abutting member 11 illustrated in FIG. 3 is maintained in a state of being biased toward one end 12*b*1 side of the sliding portion 12*b* by the tensile spring 13. In this state, if the abutting portion 11*a* abuts on the sheet front end and is thus pressed by the sheet S, the abutting member 11 starts being swung in a direction of an arrow G centering on the pivotal shaft 11*c* maintained at a position serving as a first moving center (the center of pivotal motion) as illustrated in FIG. 4B. It is noted that, the first moving center extends in a direction which is not parallel to the sheet width direction, and intersects a virtual plane parallel to the surface of the conveyed sheet.

If the sheet S is further conveyed, the abutting member 11 is continuously swung in the direction of the arrow G centering on the pivotal shaft 11*c*. It is noted that, in the present embodiment, as illustrated in FIG. 2B described above, the pivotal shaft 11*c* is inclined with the angle θ2 with respect to the normal direction N of the sheet conveyance path R. As illustrated in FIG. 3, the pivotal shaft 11*c* is inclined within a range indicated by the arrow Y along the sliding portion 12*b*. For this reason, a swing trajectory of the abutting member 11 is a trajectory in a direction in which the abutting portion 11*a* is retracted from the sheet conveyance path R. As illustrated in FIG. 2A described above, since the abutting portion 11*a* of the abutting member 11 is inclined with the angle θ1 with respect to the arm 11*b*, if the abutting member 11 is swung, the abutting angle θ3 of the sheet S changes from 90° to an acute angle.

Thereafter, if the sheet S is still further conveyed, as illustrated in FIG. 4C, the front end of the sheet S passes the abutting portion 11*a* of the abutting member 11. If the sheet front end has passed the abutting portion 11*a* as mentioned above, the pressing from the sheet S is released. Consequently, the abutting member 11 is swung in an I direction in FIG. 5A by the tensile spring 13 in a state in which the tip of the abutting portion 11*a* is in contact with the sheet S, and abuts on the abutting rib 99*b* provided at the sheet guide 99 so as to be stopped. It is noted that, the position of the abutting portion 11*a* in FIG. 4C is set to a second position.

As mentioned above, if the sheet S passes the abutting portion 11*a* of the abutting member 11, the abutting member 11 abuts on the abutting rib 99*b* and is thus moved to the side of the standby position. In other words, in the present embodiment, the abutting member 11 returns to the vicinity of the standby position until the rear end of the sheet passes, that is, during conveyance of the sheet.

It is noted that, when the abutting member 11 is swung in a state in which the tip of the abutting portion 11*a* is in contact with the sheet S, the abutting member 11 is swung (moved) in a Y1 direction along the slit-like sliding portion 12*b* of the support portion 12 while resisting against the tensile spring 13 with the round hole 12*a*1 as a supporting point. Consequently, the pivotal shaft 11*c* is moved to a position serving as a second moving center (the center of pivotal motion) when the abutting member 11 is swung in a state in which the tip of the abutting portion 11*a* is in contact with the sheet S. It is noted that, the second moving center extends in a direction which is not parallel to the sheet width direction, and intersects a virtual plane parallel to the surface of the conveyed sheet.

Figure 5A:
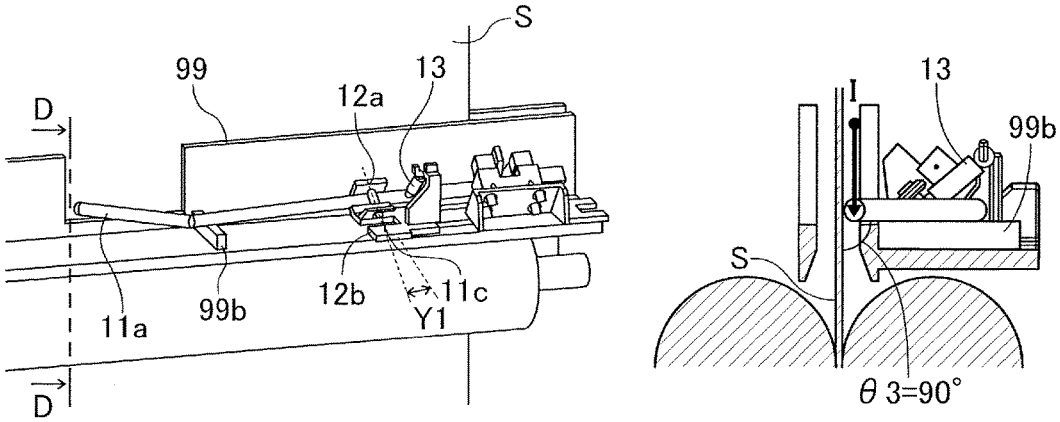
FIG. 5A shows a perspective view and a side view illustrating the sheet detection portion in a state in which the abutting portion is located at a third position.

The abutting portion 11*a* of the abutting member 11 is in a state of pressing the sheet S with an abutting angle of 90° until the rear end (direction of sheet conveyance upstream end) of the sheet S passes. The position where the abutting portion 11*a* illustrated in FIG. 5A is stopped is set to a third position. Consequently, if the rear end of the sheet S passes, the abutting member 11 is swung in a J direction by a reaction force of the tensile spring 13 right thereafter as illustrated in FIG. 5B, and the abutting portion 11*a* returns to the standby position (first position) so that the abutting portion 11*a* enters the sheet conveyance path R.

As described above, since the abutting member 11 stands by at the third position near the standby position (first position) in the direction of sheet conveyance T, the abutting member 11 returns to the standby position (first position) if the abutting member 11 has only to be moved in the normal direction N (J direction) of the sheet conveyance path R right after the sheet rear end passes during conveyance of the sheet. Therefore, the abutting member 11 is ready to accept a subsequent sheet S1.

Figure 5B:
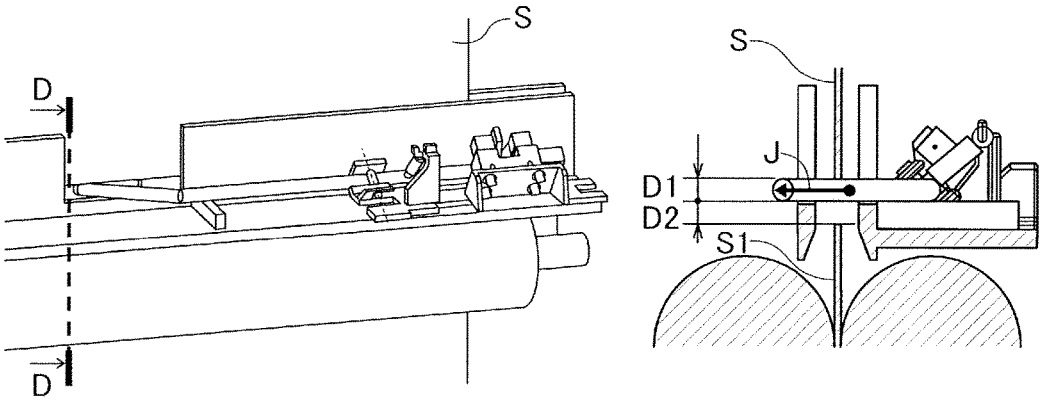
FIG. 5B shows a perspective view and a side view illustrating an operation in which the abutting portion returns from the third position to the standby position.

In this configuration, a mechanical loss until the abutting member 11 is ready to accept the subsequent sheet S1 is a sum of D1 corresponding to a thickness of the abutting member 11 in the direction of sheet conveyance and a distance D2 corresponding to a time period required for the abutting portion 11*a* to be moved in the J direction and to detect a sheet interval as illustrated in FIG. 5B. As a result, it is possible to considerably reduce the mechanical loss. Also regarding the number of components, in the present embodiment, only components including the abutting member 11 and the tensile spring 13 are necessary, and thus a simple configuration with less increase in cost is realized.

Figure 6:
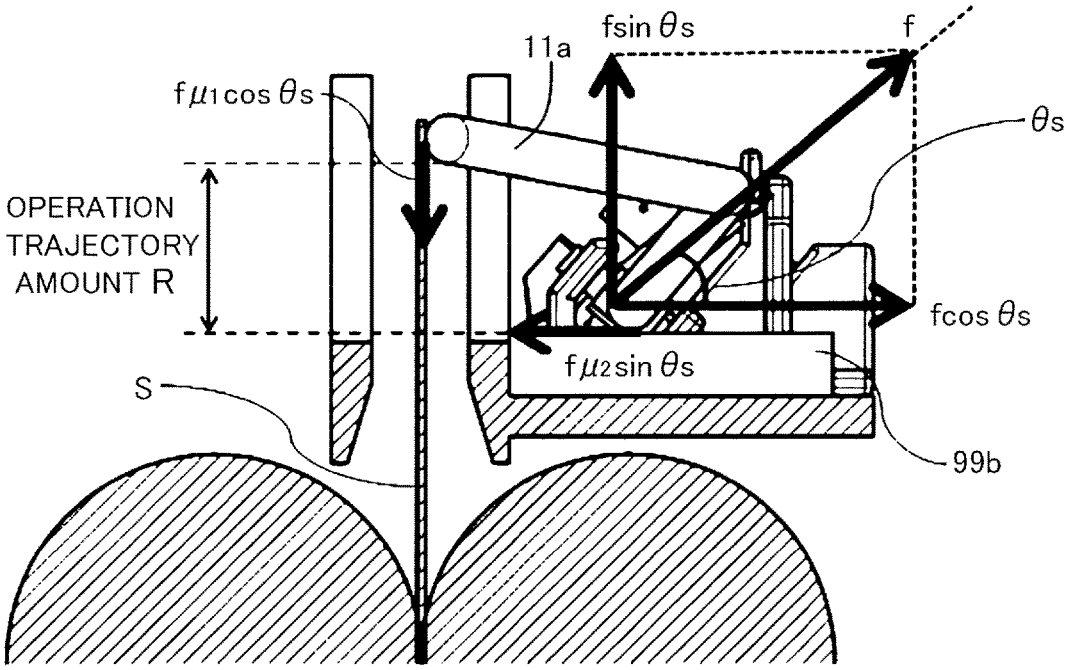
FIG. 6 is a diagram illustrating a tension spring provided at the sheet detection portion.

It is noted that, in the present embodiment, the single tensile spring 13 applies forces in two directions (the direction of sheet conveyance T and the normal direction N of the sheet conveyance path R). Thus, as illustrated in FIG. 6, if an installation angle of the tensile spring 13 is θs, a spring force is f, a dynamic friction coefficient between the sheet S and the abutting portion 11*a* is μ, and a dynamic friction coefficient between the arm 11*b* and the abutting rib 99*b* is $\mu_2$, θs is required to be set to satisfy the following relationship.

In other words, forces applied in the direction of sheet conveyance T are required to be set to satisfy the following relationship.

$$f \sin \theta s > f\mu_1 \cos \theta s$$

In other words, in the direction of sheet conveyance T, a force causing the abutting member 11 to return to the direction of sheet conveyance up stream side is represented by the returning force f sin θs of the tensile spring 13, and is thus required to be greater than the friction force $f\mu_1 \cos \theta s$ toward the direction of sheet conveyance downstream side between the sheet S and the abutting portion 11*a*.

Forces applied in the normal direction N of the sheet conveyance path R are required to be set to satisfy the following relationship.

$$f \cos \theta s > f\mu_2 \sin \theta s$$

In other words, in the normal direction N of the sheet conveyance path R, a force causing the abutting member 11 to return to the direction N of the sheet conveyance path R is represented by the returning force f cos θs of the tensile spring 13. The returning force f cos θs is required to be greater than the friction force $f\mu_2 \sin \theta s$ occurring between the abutting member 11 and the abutting rib 99*b*.

On the basis of the two relational expressions, the installation angle θs of the spring is required to be set to satisfy the following relational expression.

$$\mu_1 < \tan \theta s < 1/\mu_2$$

For example, if $\mu_1$ is set to 0.4, and $\mu_2$ is set to 0.3, the installation angle θs of the spring becomes 22°<θs<73°. It is noted that, in this case, the calculation is performed assuming that a sliding friction force of the pivotal shaft 11*c* and the own weight of the abutting member 11 are negligibly smaller than the above-described forces. In the present embodiment, since a linear sheet conveyance path is assumed, the relational expression can be obtained, but in a case where the sheet conveyance path is curved, θs is required to be set through calculation in which a relationship between forces based on the curved shaped is taken into consideration.

Next, a description will be made of the inclined angle θ2 of the pivotal shaft 11*c* of the abutting member 11 in the present embodiment. As illustrated in FIG. 2B already described above, the pivotal shaft 11*c* is inclined with the angle θ2 with respect to the normal direction N of the sheet conveyance path R. The inclined angle θ2 is required to be set to an appropriate angle so as to ensure operation stability by moving the abutting portion 11*a* of the abutting member 11 in the direction of being retracted from the sheet conveyance path R through swing of the abutting member 11.

For example, if the inclined angle θ2 of the pivotal shaft 11*c* is close to 0°, the G direction illustrated in FIG. 4B already described above becomes close to 0°. In this case, a swung angle increases until the abutting portion 11*a* of the abutting member 11 is moved to a position where the abutting portion 11*a* does not hinder conveyance of the sheet S, and thus an operation trajectory amount M illustrated in FIG. 6 also increases. On the other hand, if the inclined angle θ2 of the pivotal shaft is close to 90°, the abutting portion 11*a* of the abutting member 11 is moved to the position where the abutting portion 11*a* does not hinder conveyance of the sheet S even at a small swung angle, and thus the operation trajectory amount M decreases. However, in this case, when the abutting portion 11*a* is pressed by the sheet S, a component force applied in the G direction (swing direction) illustrated in FIG. 4B is small, and thus a force causing the abutting member 11 to be swung increases. Consequently, a hit trace may be generated on the front end of the sheet S, or the abutting member 11 may be destroyed.

Figure 7A:
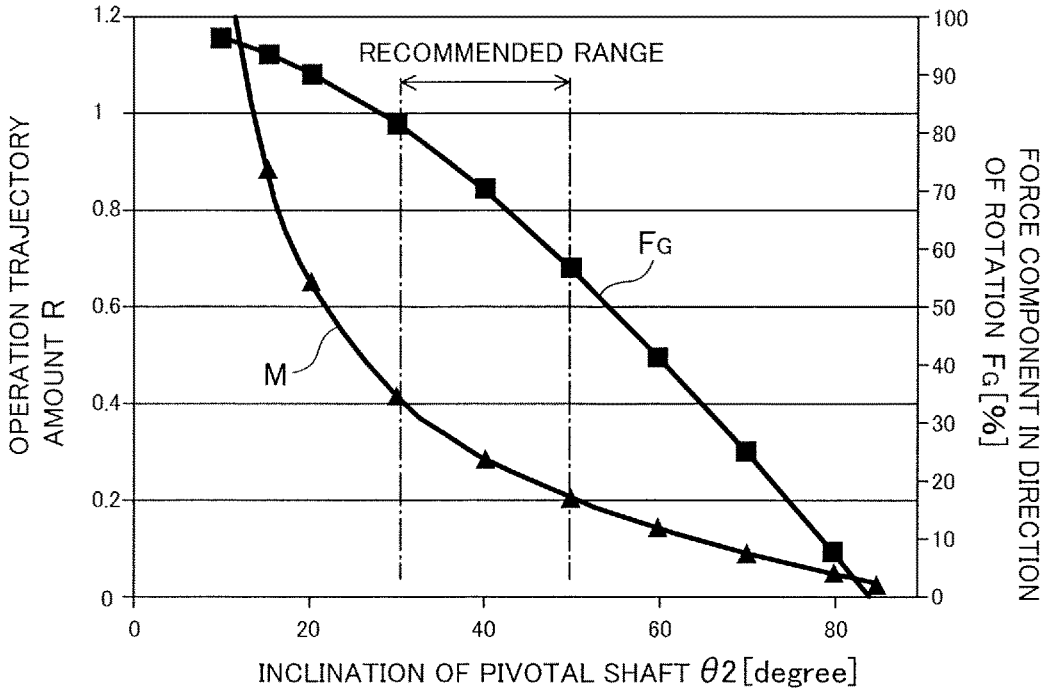
FIG. 7A is a diagram illustrating an inclined angle of a pivotal shaft of the abutting member.

Next, with reference to FIGS. 7A and 7B, a description will be made of the inclined angle θ2 at which the operation trajectory amount M of the pivotal shaft 11*c* of the abutting member 11 is compatible with a force component $F_G$ in the direction of rotation. In FIG. 7A, the left longitudinal axis expresses the operation trajectory amount M of the abutting member 11 of the present embodiment in the direction of sheet conveyance, and the right longitudinal axis expresses the force component $F_G$ applied in the G direction when the abutting portion 11*a* of the abutting member 11 is pressed by a sheet. The transverse axis in FIG. 7A expresses the inclined angle θ2 of the pivotal shaft 11*c* of the abutting member 11 of the present embodiment with respect to the normal direction N.

Figure 7B:
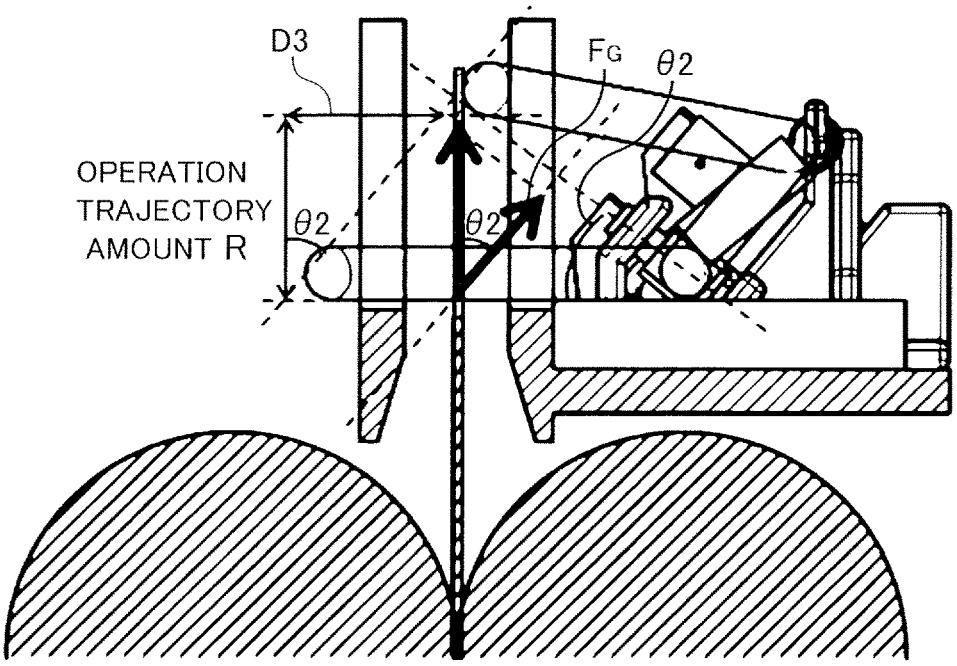
FIG. 7B is a side view illustrating an operation trajectory amount of the abutting portion.

FIG. 7B is a diagram illustrating a relationship between the operation trajectory amount M and a force with the force component $F_G$ in the direction of the pivotal shaft 11*c*. If a protrusion amount of the abutting portion 11*a* of the abutting member 11 toward the sheet conveyance path is indicated by D3, and an inclined angle of the pivotal shaft 11*c* is indicated by θ2, the operation trajectory amount M and the force component $F_G$ in the direction of the pivotal shaft 11*c* have the following relationship.

Operation trajectory amount $M=D3/\tan\theta 2$

Force component $F_G$ in direction of pivotal shaft 11*c*=cos θ2

FIG. 7A is obtained by plotting the operation trajectory amount M and the force component $F_G$ in the direction of the pivotal shaft 11*c* at each inclined angle when D3 is 2 mm. The operation trajectory amount M exhibits a downward convex function, and, especially, rapidly increases in an area (for example, 20° or less) in which the inclined angle θ2 is small, and becomes close to about zero in an area (for example, 80° or more) in which the inclined angle is large. On the other hand, the force component $F_G$ in the direction of the pivotal shaft 11*c* decreases as the inclined angle θ2 of the pivotal shaft increases, but exhibits an upward convex function unlike the operation trajectory amount M.

In the present embodiment, regarding the abutting member 11, the operation trajectory amount M is downsized as much as possible so that the abutting member can be incorporated into the apparatus body whose downsizing is progressing, and the force component $F_G$ is required to be as large as possible in order to smoothly operate the sensor without causing damage to a sheet front end. From this viewpoint, in FIG. 7A, as a recommended range of the inclined angle θ2 of the pivotal shaft 11*c* of the abutting member 11, a range between 30° and 50° is preferably used in which a difference between the operation trajectory amount M and the force component $F_G$ is greatest, and 50% or higher of the force component $F_G$ is secured.

It is noted that, when the graph of the force component $F_G$ and the operation trajectory amount M illustrated in FIG. 7A is drawn, calculation is performed assuming that a friction force between the front end of the sheet S and the abutting portion 11*a* of the abutting member 11 is negligibly small.

Figure 8A:
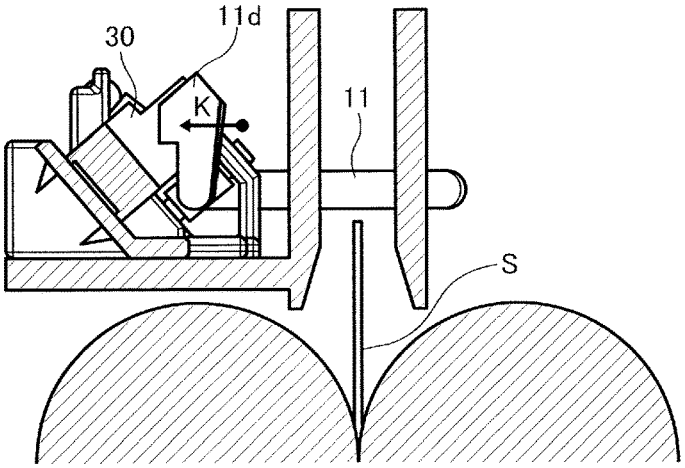
FIG. 8A is a side view illustrating a photo sensor in a state in which the abutting portion is located at the standby position.
Figure 8B:
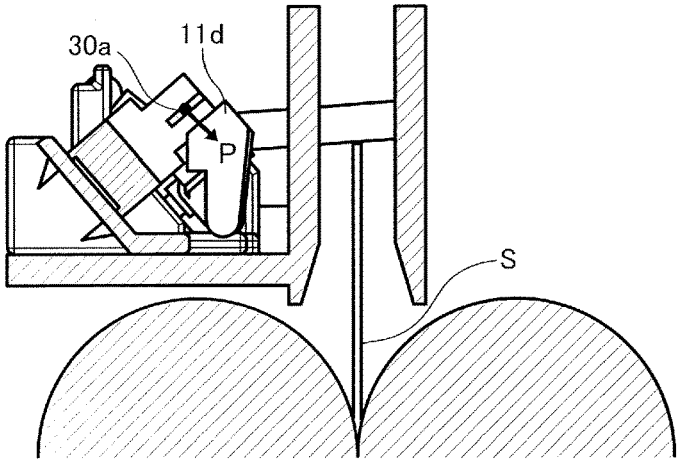
FIG. 8B is a side view illustrating the photo sensor in a state in which the abutting portion is located at the second position.

Next, a description will be made of a method in which the abutting member 11 performs detection in the present embodiment. FIG. 8A illustrates a state in which the optical axis of the photo sensor 30 is shielded from light by the light blocking portion 11*d* of the abutting member 11. Then, if the abutting member 11 is pushed up by the conveyed sheet S, as illustrated in FIG. 8B, the light blocking portion 11*d* is moved in a lower right direction P, and thus the light blocking portion 11*d* is retracted from an optical axis area 30*a* of the photo sensor 30. Consequently, the photo sensor 30 is switched from a light blocking state to a light transmitting state, and the control portion 119 detects passage of the sheet on the basis of a change in a signal from the photo sensor 30.

Figure 8C:
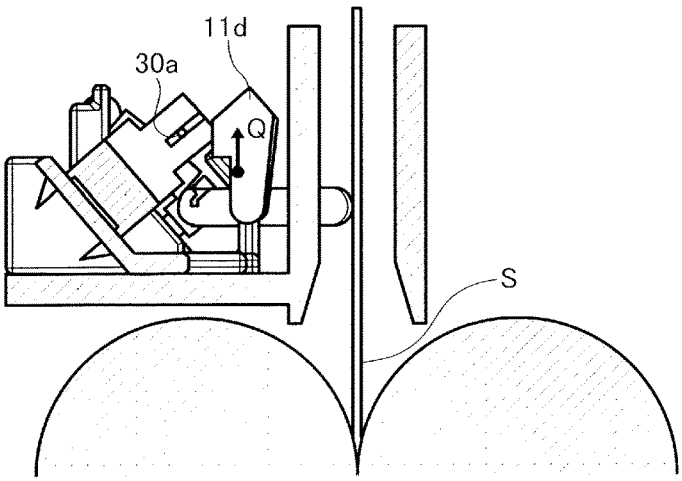
FIG. 8C is a side view illustrating the photo sensor in a state in which the abutting portion is located at the third position.

Next, if the sheet front end passes, and the abutting member 11 is swung in the I direction as illustrated in FIG. 5A already described above, the light blocking portion 11*d* is moved upward Q so as to be moved to the side of the photo sensor 30 as illustrated in FIG. 8C, and is maintained at the position until the sheet S passes. Also in this state, since the light blocking portion 11*d* is located at the position retracted from the optical axis area 30*a*, the photo sensor 30 outputs a transmission signal, and thus the control portion 119 is maintained in the state of detecting passage of the sheet.

If the sheet rear end passes the abutting member 11, the abutting member 11 is swung centering on the pivotal shaft 11*c* and thus returns to the position illustrated in FIG. 8A. The light blocking portion 11*d* is moved to the horizontally left side K illustrated in FIG. 8A due to the swing of the abutting member 11 so as to shield the optical axis area 30*a* of the photo sensor 30 from light, and the control portion 119 detects that the sheet has passed. As mentioned above, the light blocking portion 11*d* is advanced to and retracted from the optical axis area 30*a* in two directions (the P direction and the K direction) with respect to the photo sensor 30, so as to cause switching between light blocking and light transmission, and thus the front end and the rear end of the sheet S are detected. In other words, a signal from the photo sensor 30 when the abutting portion 11*a* is located at the first position is different from signals from the photo sensor 30 when the abutting portion 11*a* is located at the second position and the third position.

As described above, in the present embodiment, when the abutting portion 11*a* is pressed by the conveyed sheet, the abutting member 11 changes to a detection state while being moved in the direction of sheet conveyance and the normal direction of the sheet conveyance direction. If the pressing from the sheet is released, the abutting member 11 is moved in a direction opposite to the direction of sheet conveyance along the sheet surface and returns to the vicinity of the standby position. If the sheet has passed, the abutting member 11 returns the standby position in which the abutting portion 11*a* abuts on a sheet to be conveyed.

As mentioned above, if the pressing from the sheet is cancelled, the abutting member 11 returns to the vicinity of the standby position, and thus it is possible to shorten a time period for the abutting member 11 to return to the non-detection position after the sheet passes with a small size and at low cost.

Modification Example

Figure 9:
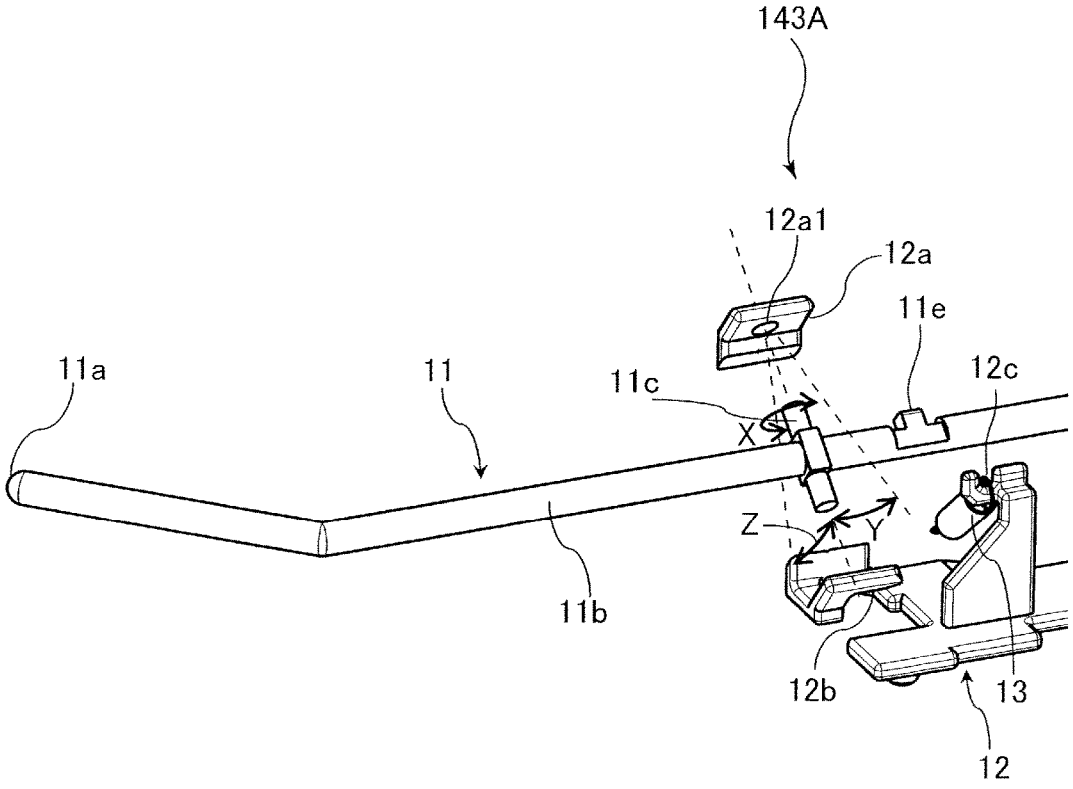
FIG. 9 is an exploded enlarged view illustrating a sheet detection portion in a modification example.

It is noted that, in the present embodiment, the sliding portion 12*b* has a slit shape, but, as illustrated in FIG. 9, may have a shape in which there is no one end 12*b*1 instead of the slit shape. Hereinafter, a configuration in which the sliding portion 12*b* does not have a slit shape will be described as a modification example with reference to FIGS. 9 to 11B. It is noted that, each of FIGS. 10A to 11B shows a perspective view of a sheet detection portion 143A of the modification example, and sectional views (a sectional view taken along the line D-D and a sectional view taken along the line E-E) in which the sheet detection portion 143A is viewed from the axial direction of the fixing roller pair 96 together.

Figure 10A:
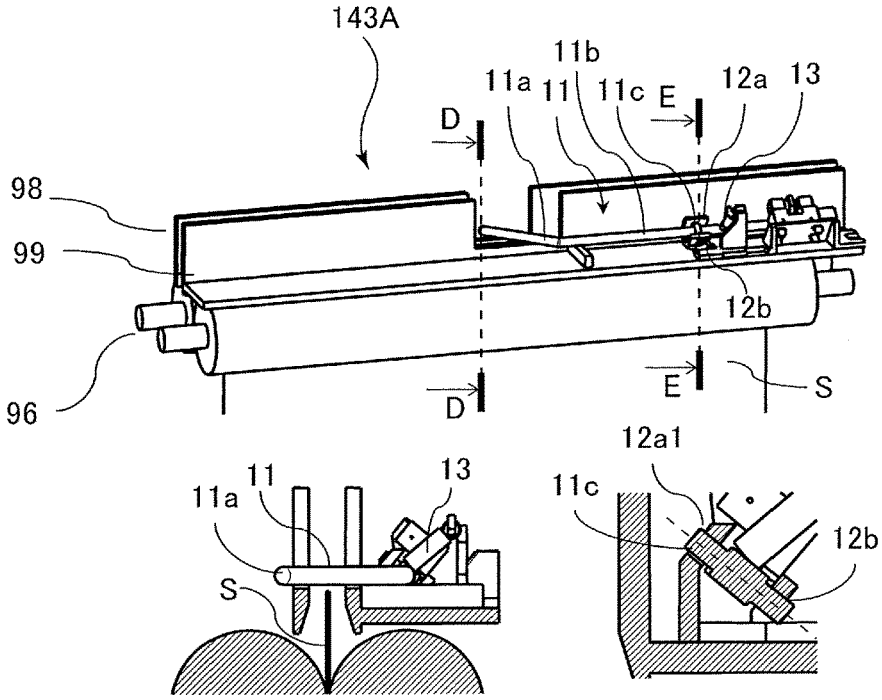
FIG. 10A shows a perspective view and a side view illustrating a sheet detection portion in a state in which an abutting portion is located at a standby position in the modification example.
Figure 10B:
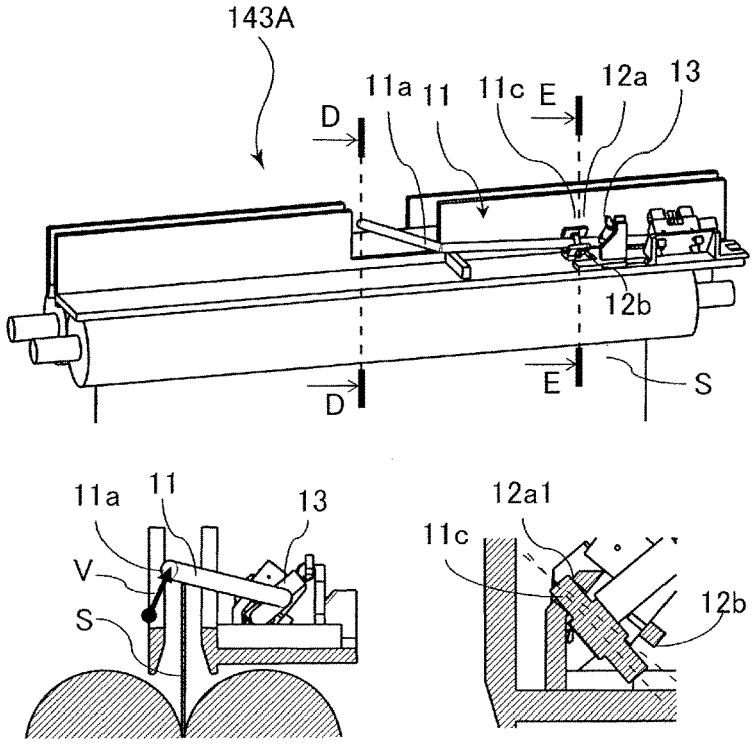
FIG. 10B shows a perspective view and a side view illustrating the sheet detection portion in a state in which a front end of a sheet abuts on the abutting portion.

FIG. 10A illustrates a state in which the abutting member 11 is located at the standby position (first position). If the sheet S abuts on the abutting portion 11*a*, first, the abutting member 11 is swung so that the shaft 11*c* is separated from the sliding portion 12*b* in a Z direction illustrated in FIG. 9 from the standby position. In other words, the abutting member 11 is swung in a direction of an arrow V as illustrated in FIG. 10B. Thereafter, the shaft 11*c* is inclined with respect to the round hole 12*a*1 so that a gap between the shaft 11*c* and the round hole 12*a*1 is removed, and the shaft

11*c* is locked to a side wall of the round hole 12*a*1 and then starts being swung in an X direction illustrated in FIG. 9.

Figure 11A:
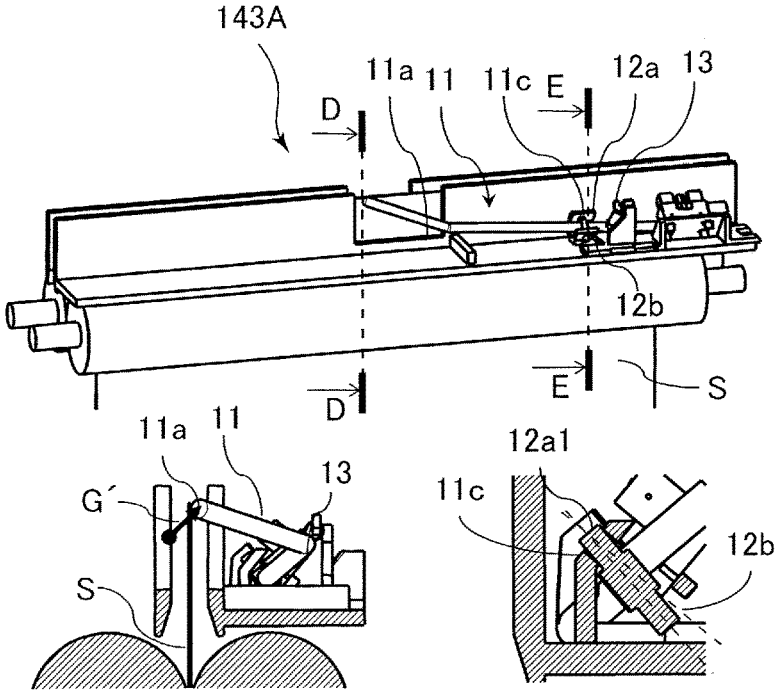
FIG. 11A shows a perspective view and a side view illustrating the sheet detection portion in a state in which the abutting portion is located at a second position.
Figure 11B:
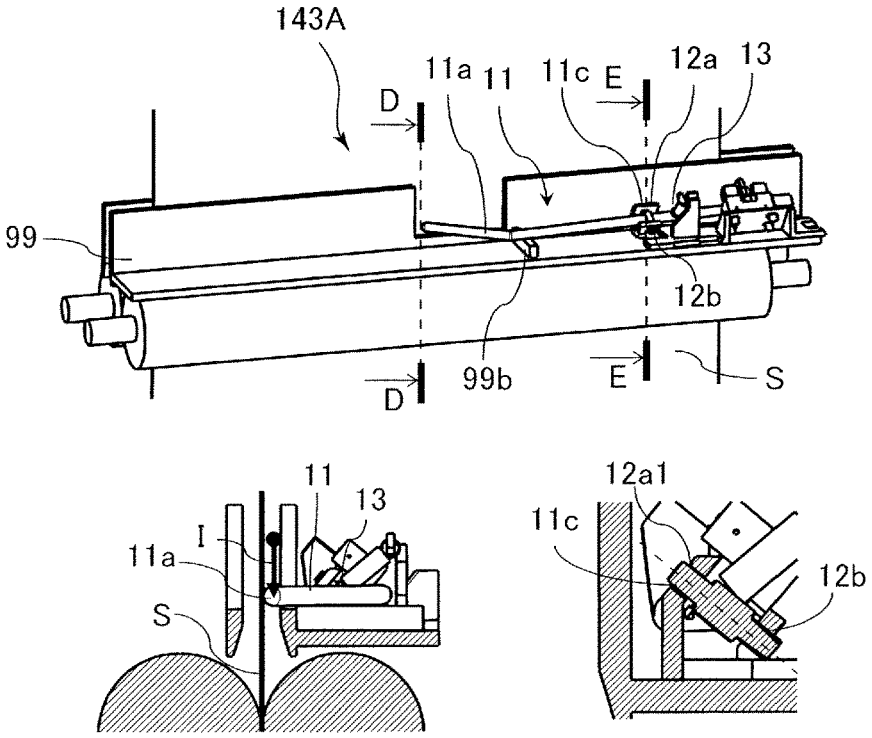
FIG. 11B shows a perspective view and a side view illustrating the sheet detection portion in a state in which the abutting portion is located at a third position.

In other words, as illustrated in FIG. 11A, the abutting member 11 is swung in a direction of an arrow G'. If the sheet front end has passed the abutting portion 11*a*, the pressing from the sheet S is released. Thus, the abutting member 11 is swung in an I direction in FIG. 11B by the tensile spring 13 in a state in which the tip of the abutting portion 11*a* is in contact with the sheet S, and abuts on the abutting rib 99*b* provided at the sheet guide 99 so as to be stopped.

At this time, the abutting member 11 is swung in the Z direction illustrated in FIG. 9 so that the shaft 11*c* abuts on the sliding portion 12*b*, and is also swung in the Y direction illustrated in FIG. 9 along the sliding portion 12*b*. Then, a motion in a condition in which the rear end of the sheet S has passed is the same as in the above-described embodiment. It is noted that, the abutting portion 11*a* is located at the second position in FIG. 11A, and is located at the third position in FIG. 11B.

Second Embodiment

Figure 12:
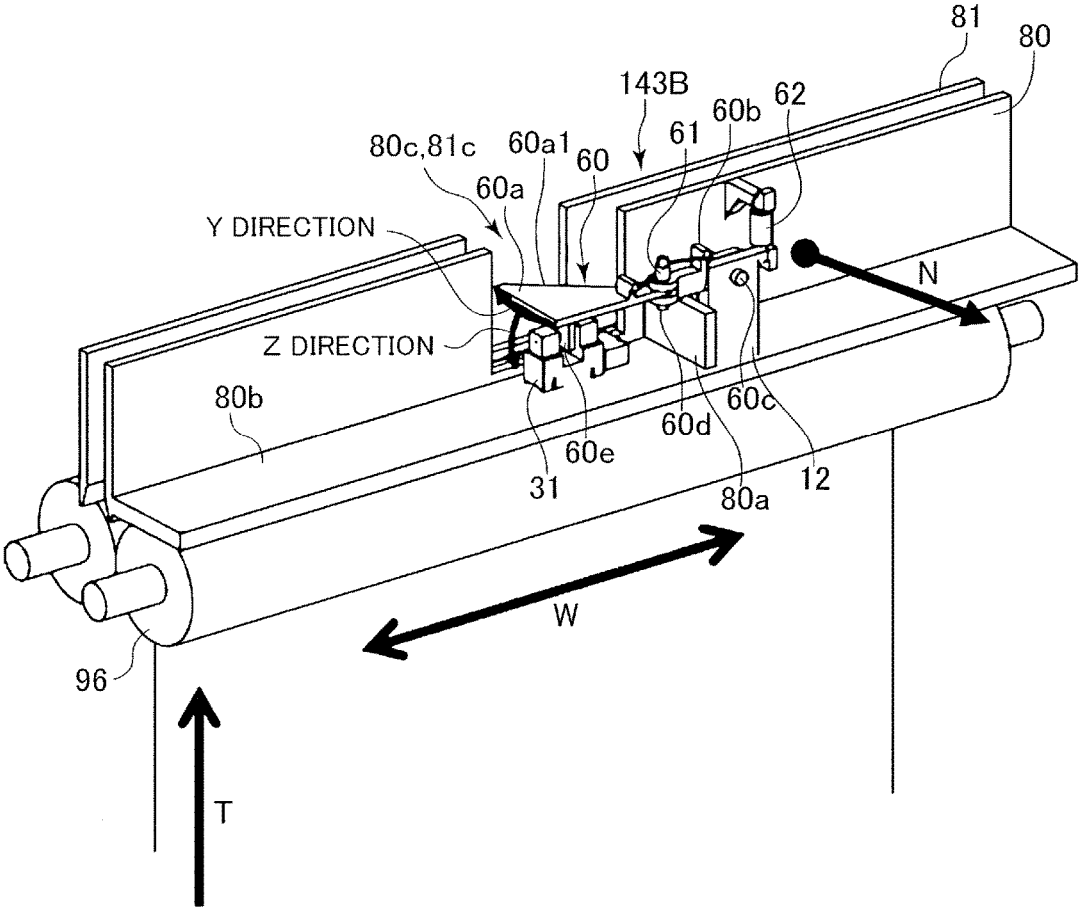
FIG. 12 is a perspective view illustrating a sheet detection portion provided in a sheet conveyance apparatus according to a second embodiment of this disclosure.

Next, a second embodiment of this disclosure will be described. FIG. 12 is a diagram illustrating a configuration of a sheet detection portion 143B (detection portion) provided in a sheet conveying device according to the present embodiment. It is noted that, in FIG. 12, the same reference numeral as in FIG. 2A already described above indicates a similar or corresponding portion.

In FIG. 12, the reference numeral 60 indicates an abutting member, and the abutting member 60 is constituted of two components such as an abutting portion 60*a* configured to abut on a sheet, and an arm member 60*b* which is a main body. The arm member 60*b* is supported by the support portion 12 so as to be swung along a plane parallel to the sheet conveyance path R with a pivotal shaft 60*c*, as a supporting point, which is a first shaft parallel to the normal direction N of the sheet conveyance path R. The abutting portion 60*a* is pivotably supported at the arm member 60*b* by a pivotal shaft 60*d* which is a second shaft parallel to the sheet conveyance direction T along a plane orthogonal to the sheet conveyance path R.

Here, the pivotal shaft 60*c* and the pivotal shaft 60*d* have a positional relationship of being orthogonal to each other when viewed from the axial direction of the fixing roller pair 96, and the pivotal shaft 60*c* and the pivotal shaft 60*d* can separately perform pivoting and swinging operations due to this positional relationship. It is noted that, in the present embodiment, the pivotal shaft 60*c* is parallel to the normal direction N of the sheet conveyance path R, and the pivotal shaft 60*d* is parallel to the direction of sheet conveyance T, but this disclosure is not limited thereto, and angle relationships of the pivotal shaft 60*c* and the pivotal shaft 60*d* may be determined according to an apparatus configuration.

The abutting portion 60*a* is biased to the arm member 60*b* in the Y direction at all times by a torsion spring 61, and abuts on a stopper (not illustrated) provided at the arm member 60*b* so as to be positioned. The arm member 60*b* is biased in the Z direction at all times by a tensile spring 62, and abuts on a rib 80*a* standing on a sheet guide 80 so as to be positioned.

Figure 13A:
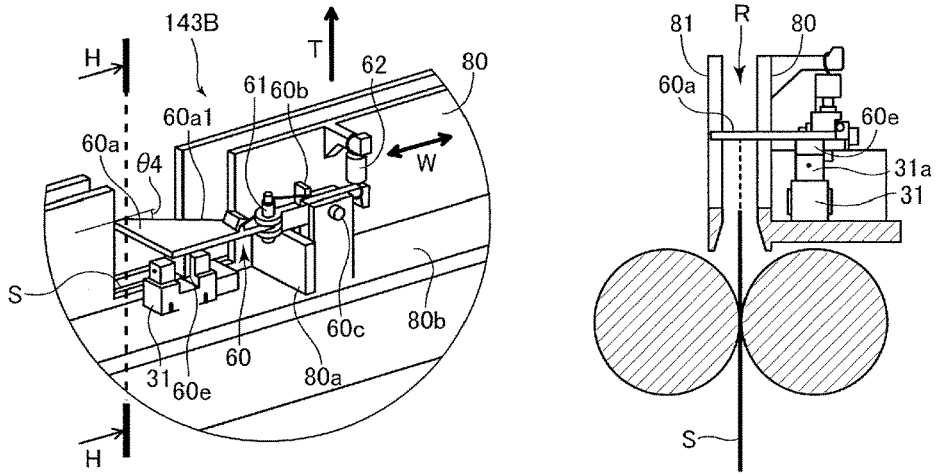
FIG. 13A shows a perspective view and a side view illustrating the sheet detection portion in a state in which an abutting portion is located at a standby position (first position).

In FIG. 12, the reference numeral 60*a*1 indicates an abutting surface coming into contact with the sheet S in a trajectory in which the abutting portion 60*a* is swung, and the abutting surface 60*a*1 is inclined with an angle θ4 with respect to a width direction W as illustrated in FIG. 13A to be described later. The reference numeral 60*e* indicates a light blocking portion provided on a bottom of the abutting portion 60*a*. The reference numerals 80 and 81 indicate sheet guides, and a sheet having passed through the fixing roller pair passes between the sheet guides 80 and 81. It is noted that, openings 80*c* and 81*c* are respectively formed in the sheet guides 80 and 81, and the abutting portion 60*a* is inserted into the openings 80*c* and 81*c* so as to come into contact with the sheet S passing between the sheet guides 80 and 81.

A support plate 80*b* stands on the sheet guide 80, and a photo sensor 31 is attached to the support plate 80*b*. If an optical path between a light-emitting portion and a light-receiving portion of the photo sensor 31 is shielded from light by the light blocking portion 60*e* provided on the bottom of the abutting portion 60*a*, a signal from the photo sensor 31 changes from an ON state to an OFF state, and thus the control portion 119 detects passage of the sheet S.

Figure 13B:
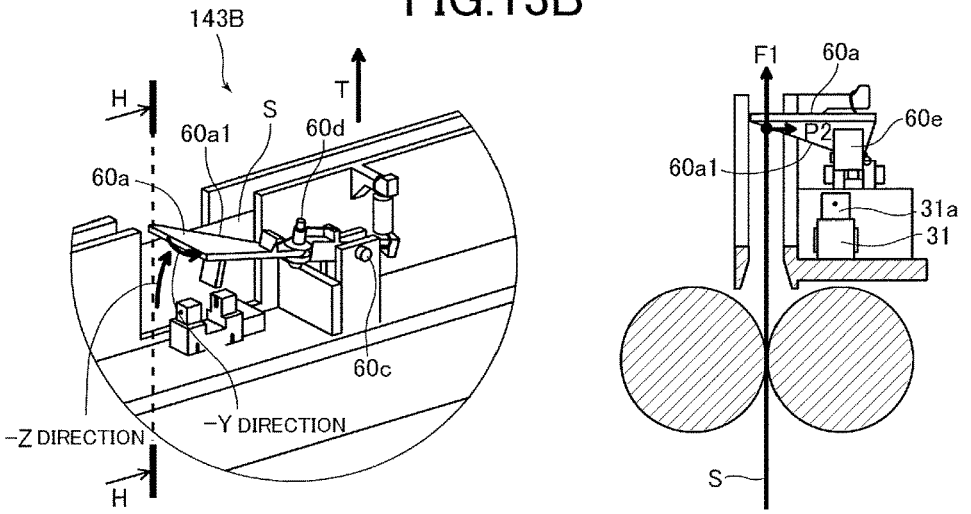
FIG. 13B shows a perspective view and a side view illustrating the sheet detection portion in a state in which a front end of a sheet abuts on the abutting portion.
Figure 13C:
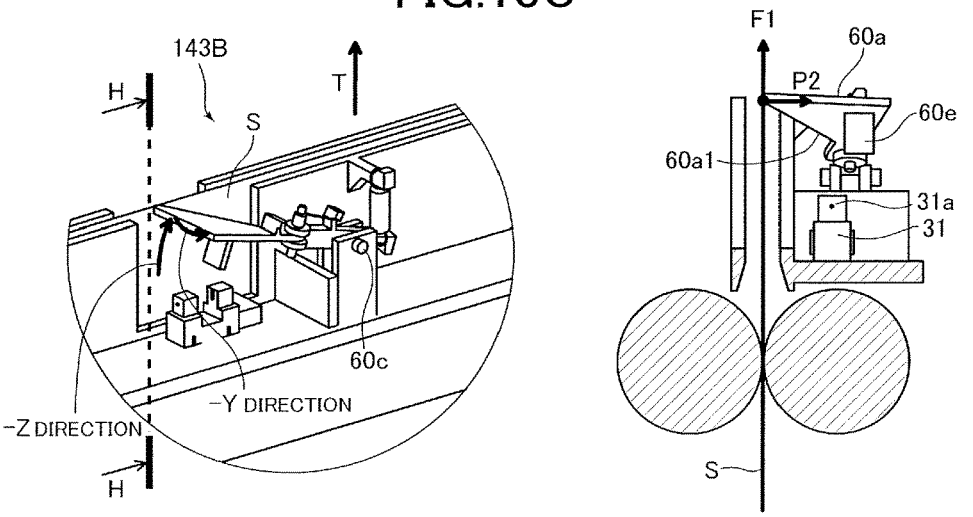
FIG. 13C shows a perspective view and a side view illustrating the sheet detection portion in a state in which the abutting portion is located at a second position.

Next, with reference to FIGS. 13A to 13C, a description will be made of an operation of the sheet detection portion 143B of the present embodiment. It is noted that, each of FIGS. 13A to 13C shows a perspective view in which the sheet detection portion 143B is viewed from the same direction as in FIG. 12, and a sectional view (a sectional view taken along the line H-H) in which the sheet detection portion 143B is viewed from the axial direction of the fixing roller pair 96 together. The abutting portion 60*a* waits for the sheet S in a state of protruding inside the sheet conveyance path R perpendicularly to the direction of sheet conveyance T until the sheet is conveyed and abuts thereon as illustrated in FIG. 13A. At this time, the abutting portion 60*a* is located at the standby position (first position).

If the sheet S is conveyed, as illustrated in FIG. 13B, the sheet front end abuts on the abutting portion 60*a*, and thus presses the abutting portion 60*a* in a direction of sheet conveyance downstream by a conveying force F1 of the sheet S. Consequently, the abutting portion 60*a* and the arm member 60*b* are integrally swung, that is, the abutting member 60 is swung in the −Z direction centering on the pivotal shaft 60*c*, that is, toward the direction of sheet conveyance downstream side along a plane parallel to the direction of sheet conveyance.

Here, as described above, the abutting surface 60*a*1 coming into contact with the sheet S is inclined with respect to the width direction W in a trajectory in which the abutting portion 60*a* is swung. As a result of the abutting surface 60*a*1 having an inclined angle (for example, an angle θ4) as mentioned above, the sheet front end presses the abutting surface 60*a*1 due to an increase in a swung angle in the −Z direction centering on the pivotal shaft 60*c* of the abutting member 60. Thus, as illustrated in FIG. 13B, a component force P2 causes the abutting portion 60*a* to be pivoted in the −Y direction, that is, a direction orthogonal to the direction of sheet conveyance with the pivotal shaft 60*d* as a supporting point.

If the sheet S is further conveyed, as illustrated in FIG. 13C, the abutting portion 60*a* is pivoted in the −Y direction by the component force P2 with the pivotal shaft 60*d* as a supporting point, and is thus completely retracted from the sheet conveyance path R. At this time, the abutting portion 60*a* is located at the second position.

Figure 14A:
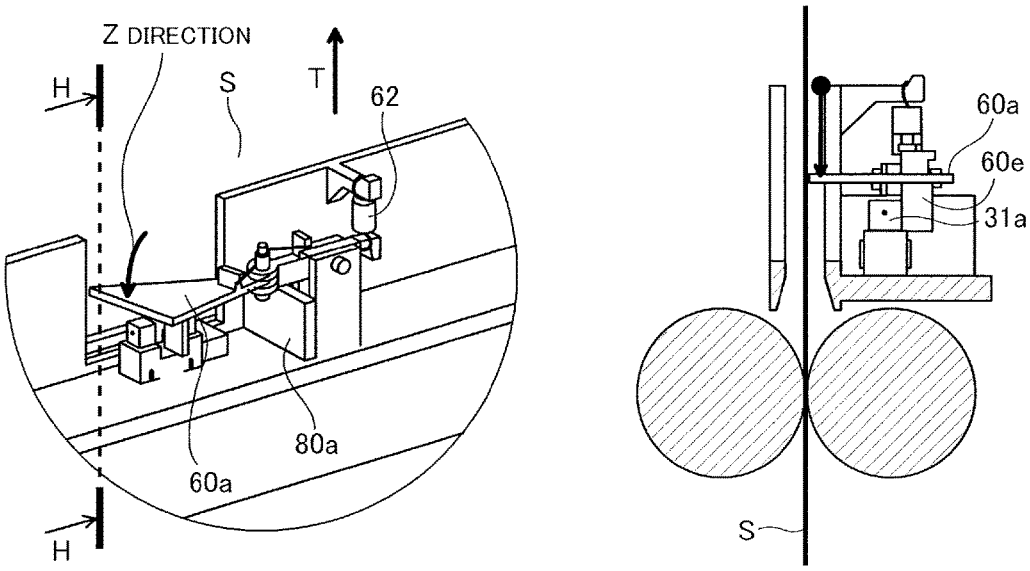
FIG. 14A shows a perspective view and a side view illustrating the sheet detection portion in a state in which the abutting portion is located at a third position.

If the front end of the sheet S has passed, as illustrated in FIG. 14A, the abutting member 60 is pivoted in the Z direction by a spring force of the tensile spring 62 so as to abut on the abutting rib 80*a*, and is thus stopped at the side of the standby position. In other words, also in the present embodiment, the abutting member 60 returns to the vicinity of the standby position until the rear end of the sheet passes, that is, during conveyance of the sheet. In this case, since the sheet S is being conveyed, the abutting portion 60*a* is rotated by a predetermined angle with respect to the arm member 60*b*, and stands by in a state in which the conveyed sheet S is pressed by a spring force of the torsion spring 61. At this time, the abutting portion 60*a* is located at the third position.

Figure 14B:
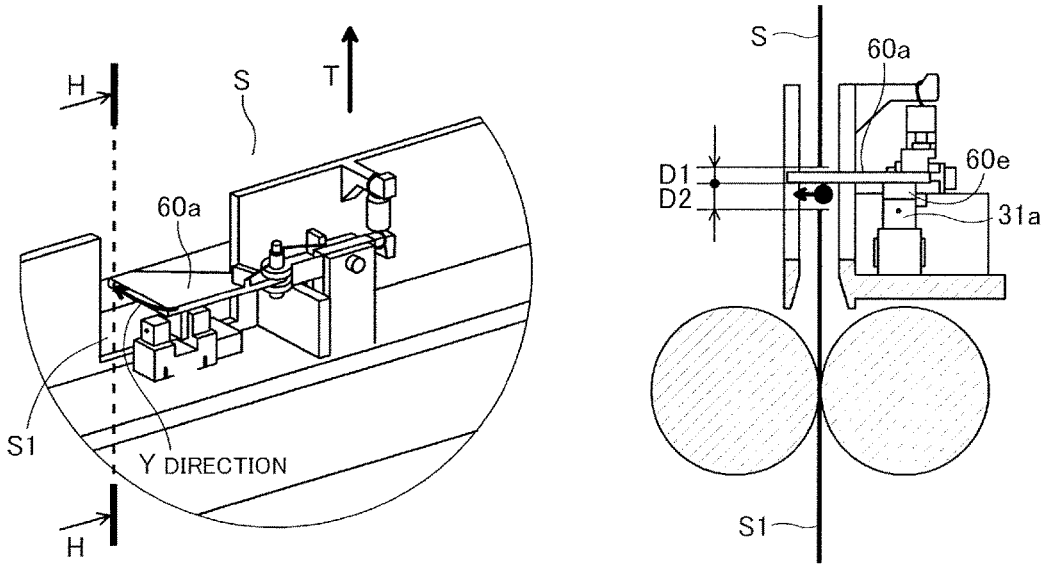
FIG. 14B shows a perspective view and a side view illustrating an operation in which the abutting portion returns from the third position to the standby position.

Next, if the sheet S is conveyed, and the rear end of the sheet S passes the abutting member 60, only the abutting portion 60*a* is pivoted in the Y direction centering on the pivotal shaft 60*d* by the spring force of the torsion spring 61 and thus returns to the standby position illustrated in FIG. 14B. In this case, in the same manner as in the first embodiment already described above, the mechanical loss D1 is a sum of a plate thickness of the abutting member 60 and a distance corresponding to a time period required for the abutting portion 60*a* to detect an sheet interval, and thus it is possible to considerably reduce a sheet interval.

Next, a description will be made of a method in which the abutting member 60 performs detection. When the abutting member 60 is located at the standby position, as illustrated in FIG. 13A, an optical axis 31*a* of the photo sensor 31 is shielded from light by the light blocking portion 60*e* of the abutting portion 60*a*. In this case, the abutting portion 60*a* extends in a direction perpendicular to the sheet S, and thus the abutting portion 60*a* receives a force in the same direction as the direction of sheet conveyance when the front end of the sheet S abuts thereon.

Next, as illustrated in FIG. 13B, if the abutting portion 60*a* is pressed and is pushed up by the sheet front end, the light blocking portion 60*e* is retracted from the optical axis 31*a* of the photo sensor 31 so that the photo sensor 31 is turned on, and thus the control portion 119 detects passage of the sheet. While the sheet is being conveyed, as illustrated in FIG. 13C, the light blocking portion 60*e* is operated at the position which is considerably retracted from the optical axis 31*a* of the photo sensor 31, and thus the photo sensor 31 is maintained in a state (ON state) of detecting that the sheet is passing.

During conveyance of the sheet after the sheet front end is passed, as illustrated in FIG. 14A, the abutting member 60 returns to the same level as the standby position in the direction of sheet conveyance and stands by at the position retracted from the sheet conveyance route. Also in this state, the light blocking portion 60*e* is retracted from the optical axis 31*a* of the photo sensor 31, and thus the photo sensor 31 is maintained in the sheet detection state. In other words, the abutting member 60 of the present embodiment detects the front end and the rear end of the sheet in two directions since a direction in which the abutting member 60 passes through the optical axis of the photo sensor 31 differs in sheet front end detection and rear end detection. The abutting portion 60*a* returns to the standby position as illustrated in FIG. 14B right after the rear end of the sheet S passes, and thus the light blocking portion 60*e* shields the optical axis 31*a* of the photo sensor 31 from light again. Consequently, the photo sensor 31 is turned off, and thus the control portion 119 detects that the sheet has passed.

As described above, in the present embodiment, if the abutting portion 60*a* is pressed by the conveyed sheet, the abutting portion 60*a* is moved along the plane orthogonal to the direction of sheet conveyance. If the pressing from the sheet is released, the abutting portion 60*a* is moved in a direction opposite to the direction of sheet conveyance along the sheet surface. If the sheet has passed, the abutting portion 60*a* returns to the position where the abutting portion 60*a* abuts on a sheet to be conveyed.

In other words, if the abutting portion 60*a* is pressed by the conveyed sheet, the abutting member 60 is moved in the direction of sheet conveyance while the abutting portion 60*a* is moved in a direction along the plane orthogonal to the direction of sheet conveyance. If the pressing from the sheet is released, the abutting member 60 is moved in a direction opposite to the direction of sheet conveyance along the sheet surface. If the sheet has passed, the abutting member returns to the standby position where the abutting portion 60*a* abuts on a sheet to be conveyed. Consequently, it is possible to achieve the same effect as in the first embodiment already described above.

Third Embodiment

Figure 15:
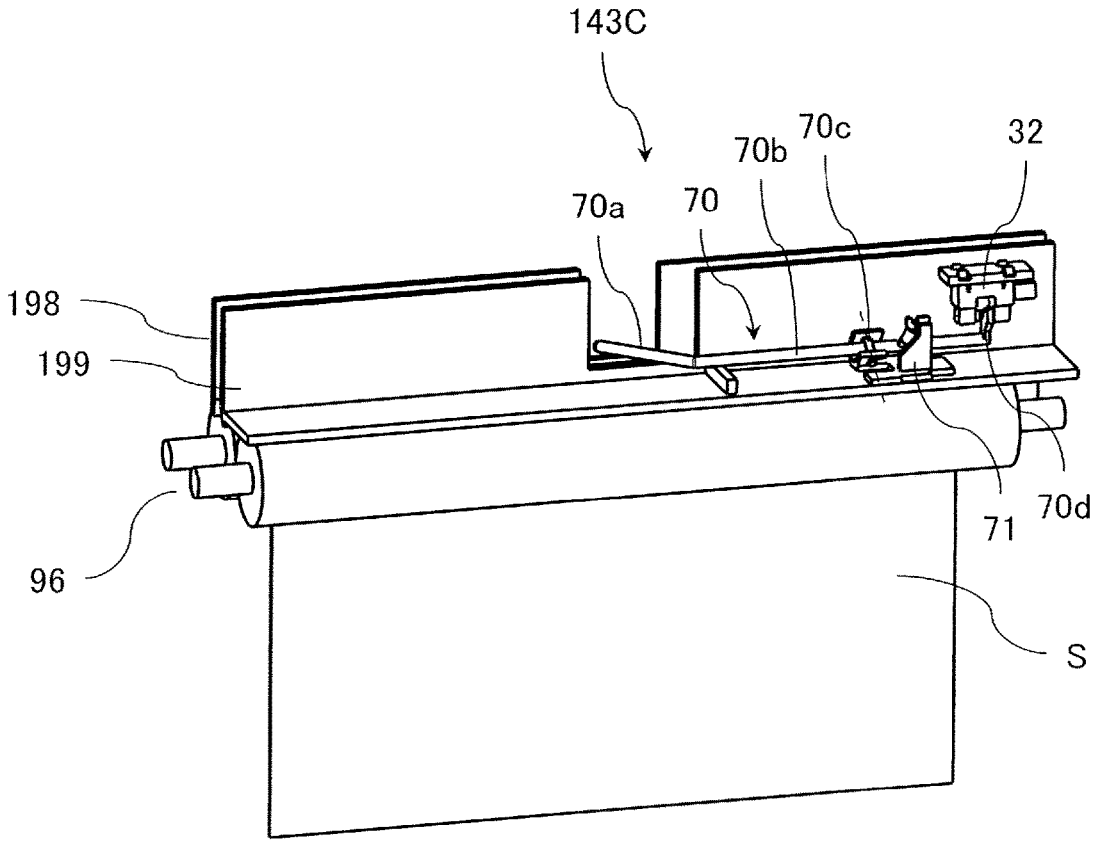
FIG. 15 is a perspective view illustrating a sheet detection portion provided in a sheet conveyance apparatus according to a third embodiment of this disclosure.

Next, a third embodiment of this disclosure will be described. FIG. 15 is a diagram illustrating a configuration of a sheet detection portion 143C (detection portion) provided in a sheet conveyance device according to the present embodiment. It is noted that, in FIG. 15, the same reference numeral as in FIG. 2A already described above indicates a similar or corresponding portion.

In FIG. 15, the reference numeral 70 indicates an abutting member which is supported by a support portion 71 provided at a sheet guide 199, via a pivotal shaft 70*c* which is a shaft portion. A light blocking portion 70*d* is provided at an end of the abutting member 70, and a photo sensor 32 is supported at a position corresponding to the light blocking portion 70*d* on the sheet guide 199. A description will be made of a method in which the abutting member 70 performs detection in the present embodiment with reference to FIGS. 16A to 18C.

It is noted that, each of FIGS. 16A to 17C shows a perspective view of the sheet detection portion 143C of the present embodiment, and a sectional view (a sectional view taken along the line F-F) in which the sheet detection portion 143C is viewed from the axial direction of the fixing roller pair 96 together. FIGS. 18A and 18B are respectively sectional views (sectional views taken along the line D-D) which are viewed from the axial direction of the fixing roller pair 96 in FIGS. 17B and 17C. In the present embodiment, unlike the first embodiment, the control portion 119 determines that a sheet is passing when the photo sensor 32 is turned off, and determines that there is no sheet when the photo sensor 32 is turned on.

Figure 16A:
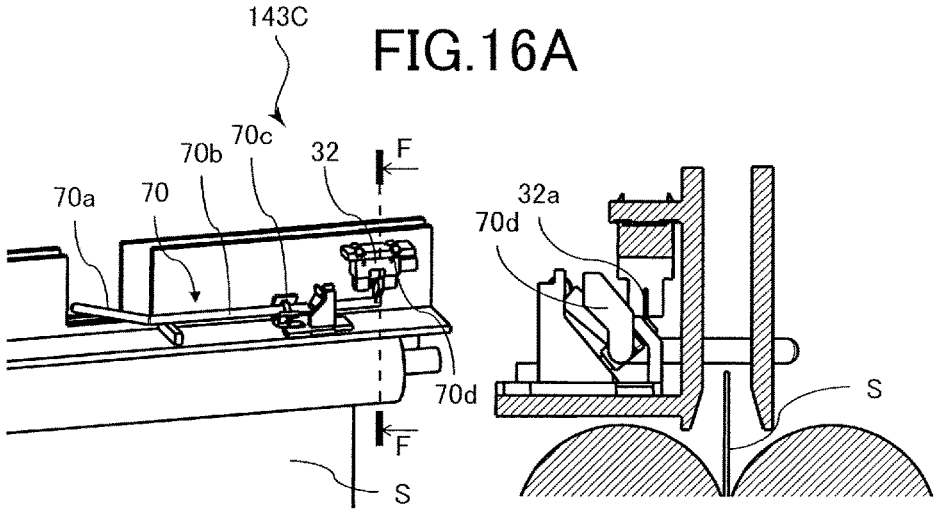
FIG. 16A shows a perspective view and a side view illustrating the sheet detection portion in a state in which an abutting portion is located at a standby position (first position).
Figure 16B:
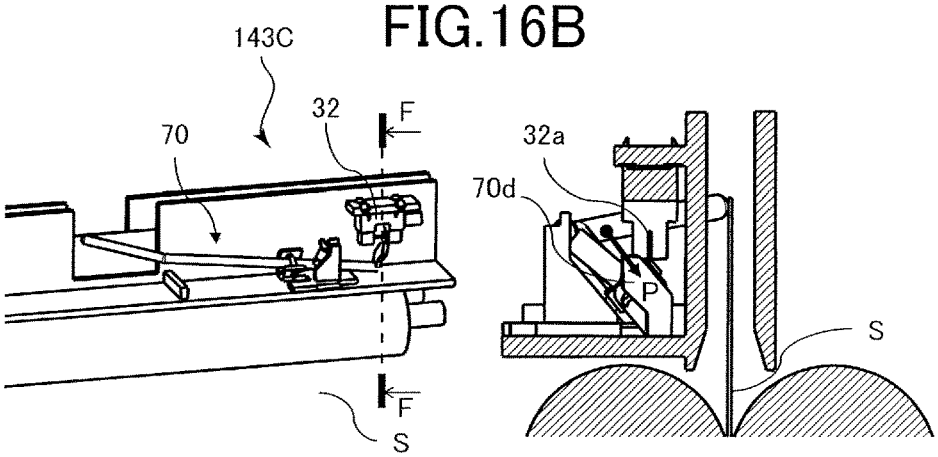
FIG. 16B shows a perspective view and a side view illustrating the sheet detection portion in a state in which the abutting portion is located at a second position.

FIG. 16A illustrates a state (non-detection state) in which an abutting portion 70*a* is located at the standby position (first position) so as to abut on the sheet S. In this state, the light blocking portion 70*d* does not shield the photo sensor 32 from light. In other words, the photo sensor 32 is turned on, and thus the control portion 119 determines that there is no sheet. Then, if the abutting member 70 is pushed up by the conveyed sheet S, the light blocking portion 70*d* is moved in a direction of an arrow P illustrated in FIG. 16B. In this state, since the light blocking portion 70*d* is located at the position retracted from an optical axis area 32*a*, the photo sensor 32 is still turned on, and thus the control portion 119 does not detect passage of a sheet yet. At this time, the abutting portion 70*a* is located at the second position.

Figure 16C:
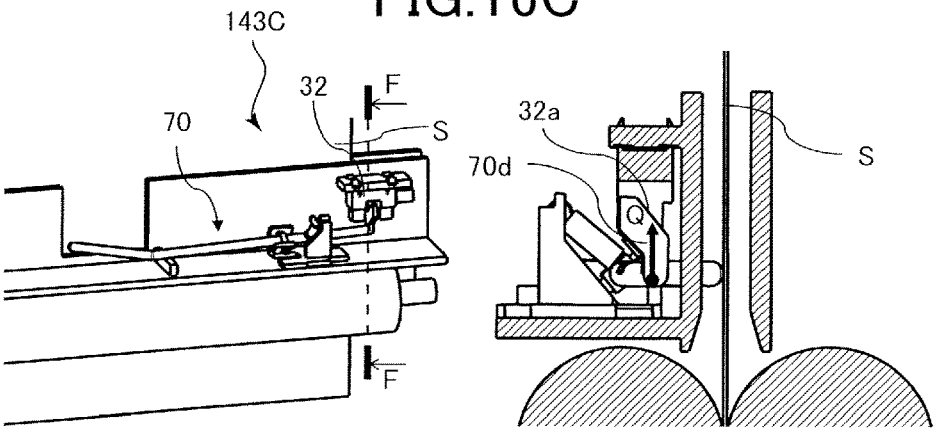
FIG. 16C shows a perspective view and a side view illustrating the sheet detection portion in a state in which the abutting portion is located at a third position.

Next, as illustrated in FIG. 16C, if a front end of the sheet S passes the abutting portion 70*a* of the abutting member 70, and the abutting member 70 is moved to the side of the standby position, the light blocking portion 70*d* is moved in a direction of an arrow Q and thus enters the optical axis area 32*a* of the photo sensor 32. Consequently, the photo sensor 32 changes from an ON state to an OFF state, and thus the control portion 119 detects passage of the front end of the sheet S on the basis of a change in a signal from the photo sensor 32. At this time, the abutting portion 70*a* is located at the third position.

Figure 17A:
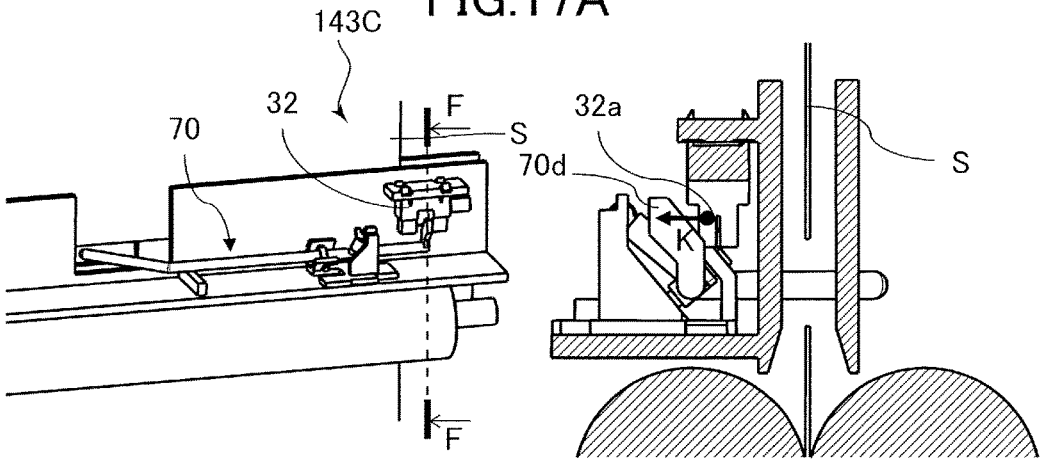
FIG. 17A shows a perspective view and a side view illustrating an operation in which the abutting portion returns from the third position to the standby position.
Figure 18A:
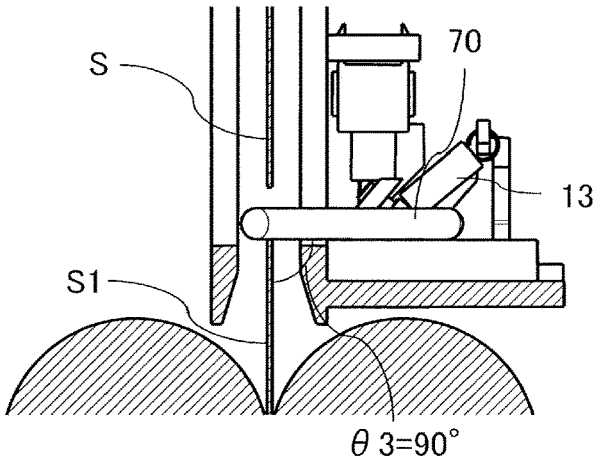
FIG. 18A illustrates a state in which a subsequent sheet abuts on the abutting portion before the abutting portion returns from the third position to the standby position.
Figure 18B:
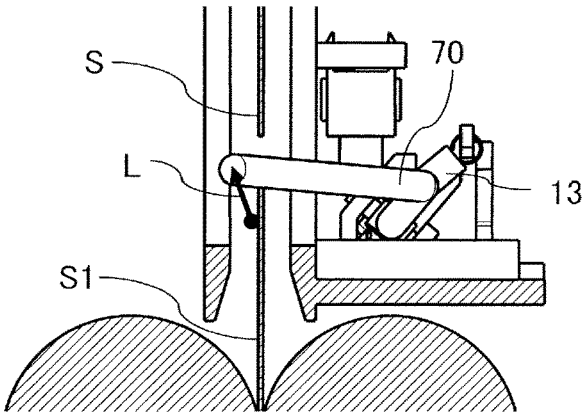
FIG. 18B is a side view illustrating a state in which the abutting portion is pushed up by the subsequent sheet.

Next, as illustrated in FIG. 17A, if a rear end of the sheet S passes the abutting member 70, the abutting member 70 is swung centering on the pivotal shaft 70*c* and thus returns to the standby position. As a result of the abutting member 70 being swung, the light blocking portion 70*d* is moved in a K direction so as to be retracted from the optical axis area 32*a* of the photo sensor 32. Consequently, the photo sensor 32 changes from an OFF state to an ON state, and thus the control portion 119 detects that the rear end of the sheet S has passed on the basis of a change in a signal from the photo sensor 32.

Figure 17B:
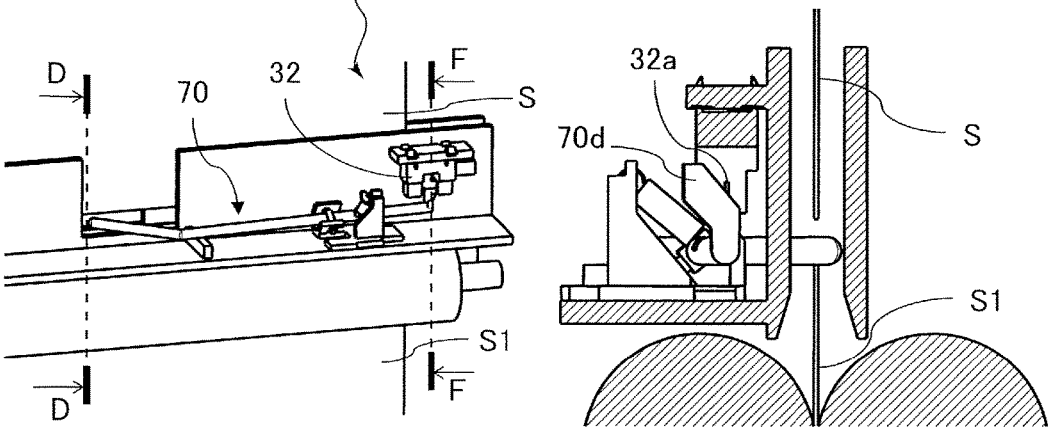
FIG. 17B shows a perspective view and a side view illustrating a state in which a subsequent sheet abuts on the abutting portion before the abutting portion returns from the third position to the standby position.

Here, as illustrated in FIGS. 17B and 18A, a description will be made of a state in which a subsequent sheet S1 abuts on the abutting member 70 before the rear end of the sheet S passes the abutting member 70, and the abutting member 70 completely returns to the standby position. If a time period until the subsequent sheet S1 abuts on the abutting member 70 after the rear end of the sheet S passes the abutting member 70 is shorter than a time period in which the light blocking portion 70*d* is retracted from the optical axis area 32*a* of the photo sensor 32, the photo sensor 32 does not change from an OFF state to an ON state.

Figure 17C:
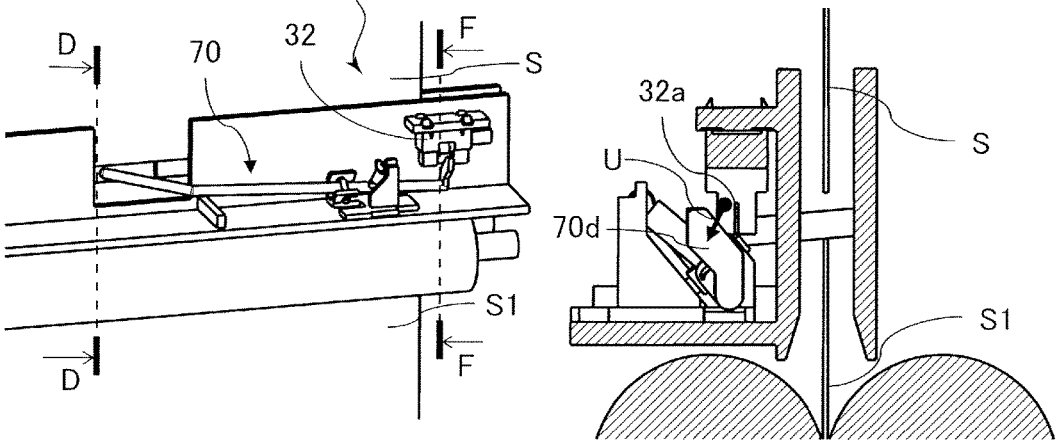
FIG. 17C shows a perspective view and a side view illustrating a state in which the abutting portion is pushed up by the subsequent sheet.

Therefore, the control portion 119 does not detect that the rear end of the sheet S has passed at the timing in FIG. 17B. FIGS. 17C and 18B are diagrams illustrating a state in which the abutting member 70 is pushed up by the conveyed subsequent sheet S1 thereafter. As a result of the subsequent sheet S1 pressing the abutting member 70 with an abutting angle of 90°, the subsequent sheet S1 swings the abutting member 70 in the direction of the arrow G as illustrated in FIG. 4B.

On the other hand, the tensile spring 13 swings the abutting member 70 in the direction of the arrow J as illustrated in FIG. 5B. The abutting member 70 is swung in a direction of an arrow L which is a direction of a resultant force of a force applied in the direction of the arrow G and a force applied in the direction of the arrow J as illustrated in FIG. 18B, by the forces applied from the sheet S1 and the tensile spring 13. Thus, the light blocking portion 70*d* is moved in a direction of an arrow U as illustrated in FIG. 17C so as to be retracted from the optical axis area 32*a* of the photo sensor 32. Consequently, the photo sensor 32 changes from an OFF state to an ON state, and thus the control portion 119 detects that the rear end of the sheet S has passed on the basis of a change in a signal from the photo sensor 32. As mentioned above, in the present embodiment, even in a case where the abutting portion 70*a* is pressed by the subsequent sheet S1 while the abutting portion 70*a* does not return to the standby position after the rear end of the sheet S passes, it is possible to detect that the sheet S has passed.

Figure 18C:
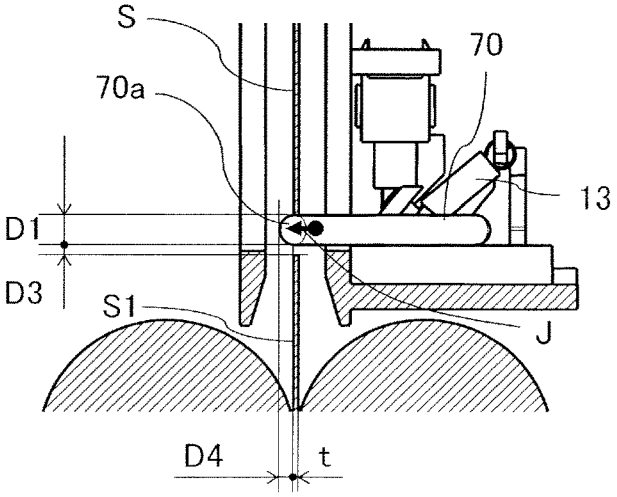
FIG. 18C is a side view illustrating a mechanical loss.

In the first embodiment, a mechanical loss until the abutting member 11 is ready to accept the subsequent sheet S1 after the rear end of the sheet S passes is a sum of D1 corresponding to a thickness of the abutting member 11 in the direction of sheet conveyance and a distance D2 corresponding to a time period required for the abutting portion 11*a* to be moved in the J direction and to detect an sheet interval as illustrated in FIG. 5B. A mechanical loss in the present embodiment is a sum of D1 corresponding to a thickness of the abutting member 70 in the direction of sheet conveyance and a distance D3 in which the abutting portion 70*a* is moved in the J direction and is then moved to the position where the abutting portion 70*a* is pressed by the subsequent sheet S1 with the abutting angle of 90° as illustrated in FIG. 18C.

The distance D1 is required to have a predetermined margin so that a state of an output from the photo sensor does not change even in a case where the sheet S is positionally deviated relative to the normal direction N of the sheet conveyance path R in the state illustrated in FIG. 16C. As illustrated in FIG. 18C, the distance D3 is a distance corresponding to a time period for the abutting portion 70*a* to be moved in the J direction by only a sum of a tip diameter D4 of the abutting portion 70*a* and a thickness t of the sheet, and is shorter than the distance D2 illustrated in FIG. 5B.

Therefore, in the present embodiment, it is possible to reduce a mechanical loss more than in the first embodiment. It is noted that, the abutting member 70 of the present embodiment is implemented in a form equivalent to the form of the first embodiment, but may be implemented in a form equivalent to the form of the second embodiment.

Fourth Embodiment

Meanwhile, a photo sensor used in a sheet conveyance apparatus has a property of being weak for heat. In a case where the temperature around the sheet guide becomes higher than a heat resistant temperature of the photo sensor due to heat generated from the fixing roller pair, the photo sensor cannot be disposed near the sheet guide in the configurations of the first to third embodiments described hitherto.

Figure 19:
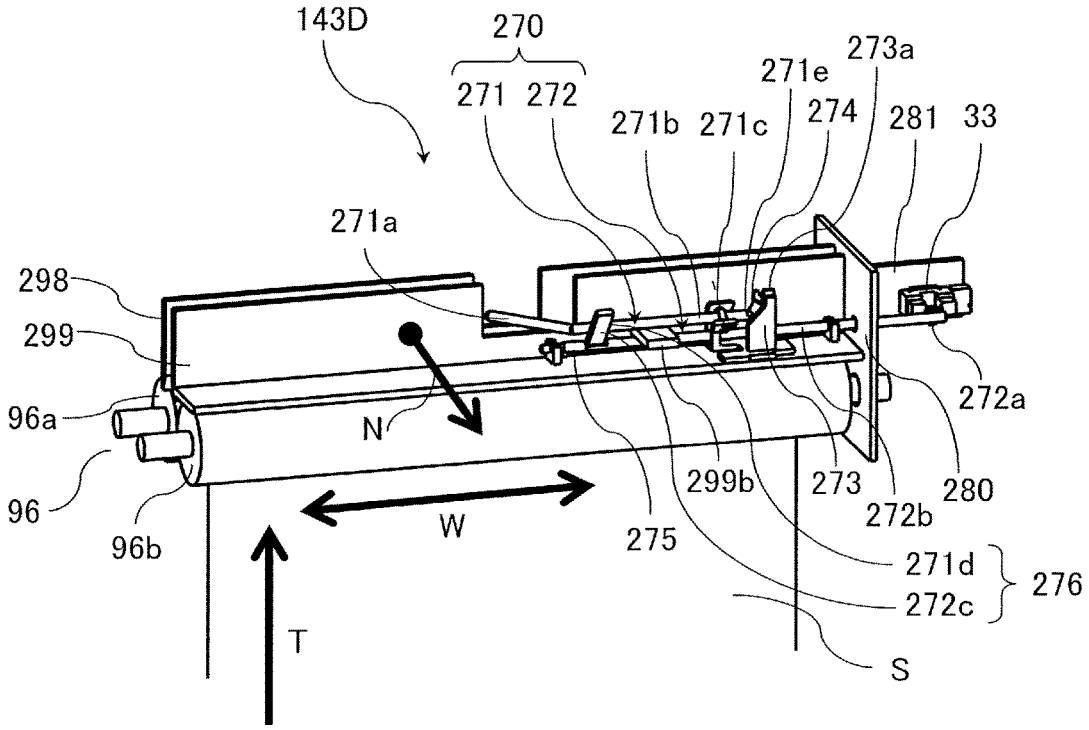
FIG. 19 is a perspective view illustrating a sheet detection portion provided in a sheet conveyance apparatus according to a fourth embodiment of this disclosure.

FIG. 19 is a diagram illustrating a configuration of a sheet detection portion 143D provided in a sheet conveyance apparatus according to the fourth embodiment of this disclosure as a configuration which causes the effect of this disclosure to be achieved even in such a case. It is noted that, in FIG. 19, the same reference numeral as in FIG. 2A already described above indicates a similar or corresponding portion.

In FIG. 19, the reference numeral 280 indicates a side plate disposed perpendicularly to the width direction W orthogonal to the direction of sheet conveyance, and rotatably supports the fixing roller 96*a* and the pressing roller 96*b*. A photo sensor 33 is disposed on an opposite side to the fixing roller pair 96 with the side plate 280 interposed therebetween, and is thus disposed in an environment of the heat resistant temperature or lower so as to be protected from heat generated from the fixing roller pair 96 by the side plate 280. The photo sensor 33 is supported by a sensor support member 281 provided at the side plate 280.

As mentioned above, in a case where the photo sensor 33 is disposed on an opposite side to the fixing roller pair 96 with the side plate 280 interposed therebetween, if a light blocking portion which can shield the photo sensor from light is integrally formed with the abutting member as in the first to third embodiments, in the abutting member, the abutting portion of one end is disposed at the roller width center, and the light blocking portion of the other end is disposed on an opposite side to the abutting portion with the side plate 280 outside the roller width interposed therebetween. Therefore, the abutting member is lengthened in the width direction W.

Thus, an operation trajectory of the abutting member during detection of a sheet increases, and thus it is hard to downsize the printer body. For this reason, the side plate 280 is necessarily notched so as to match a motion of the abutting member.

As a result, heat generated from the fixing nip is likely to be forwarded to the photo sensor side, and thus there is a possibility that the temperature of the environment near the photo sensor may increase and may exceed the heat resistant temperature of the photo sensor 33. Therefore, in the present embodiment, as illustrated in FIG. 19, an abutting member 270 is constituted of two components such as a pivotal member 271 including an abutting portion 271*a*, an arm 271*b*, a pivotal shaft 271*c*, and a joint portion 271*d*, and a light blocking member 272 including a light blocking portion 272*a*, a rotation shaft 272*b*, and a joint portion 272*c*.

The pivotal member 271 includes the arm 271*b* disposed in parallel to the width direction W orthogonal to the direction of sheet conveyance, and the abutting portion 271*a* provided at a tip of the arm 271*b*. The pivotal member 271 is supported by a support portion 273 provided at a sheet guide 299, via the pivotal shaft 271*c* which is a shaft portion. The light blocking member 272 includes the rotation shaft 272*b* extending in parallel to the width direction W orthogonal to the direction of sheet conveyance, and the light blocking portion 272*a* provided at a position corresponding to the photo sensor 33 at a tip of the rotation shaft 272*b*. The pivotal member 271 and the light blocking member 272 come into contact with a joint 276 constituted of the joint portion 271*d* and the joint portion 272*c*. A torsion spring 275 is provided at the light blocking member 272, and biases the light blocking member 272 toward the pivotal member 271.

Therefore, the light blocking member 272 is rotated around the rotation shaft 272*b* in tracking of a motion of the pivotal member 271. In other words, the motion of the pivotal member 271 which is moved in two-axis directions according to conveyance of the sheet S is converted into a motion of rotation of the light blocking member 272 centering on the rotation shaft 272*b* via the joint 276.

A description will be made of a method in which the abutting member 270 performs detection in the present embodiment with reference to FIGS. 20A to 21B. It is noted that, each of FIGS. 20A to 21B shows a perspective view of the sheet detection portion 143D of the present embodiment, and sectional views (a sectional view taken along the line B-B and a sectional view taken along the line C-C) in which the sheet detection portion 143D is viewed from the axial direction of the fixing roller pair 96 together.

Figure 20A:
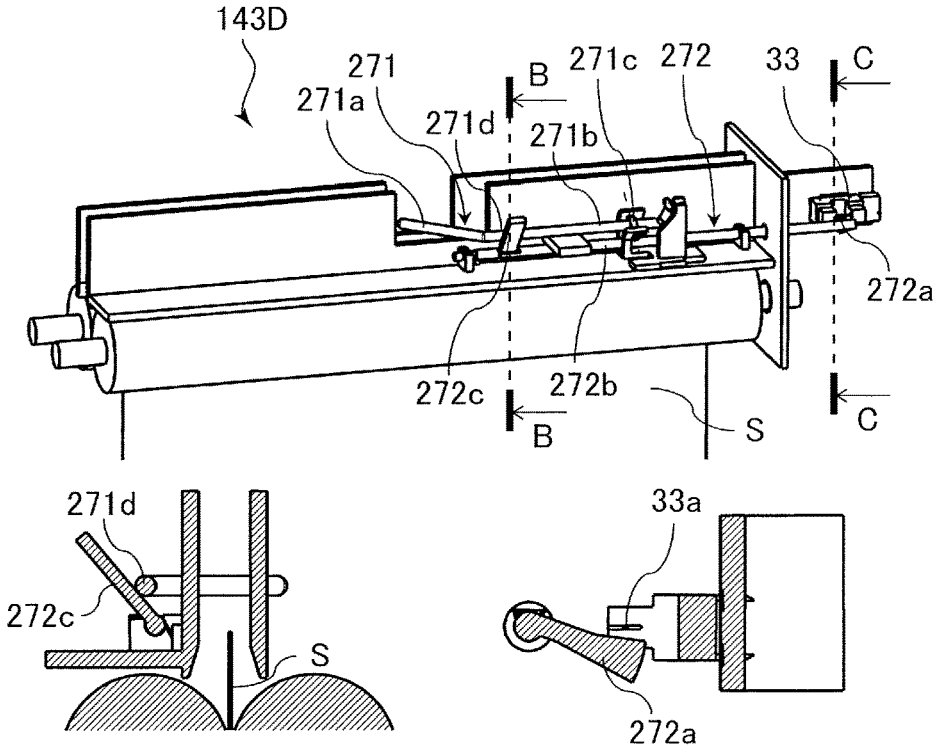
FIG. 20A shows a perspective view and a side view illustrating the sheet detection portion in a state in which an abutting portion is located at a standby position (first position).

In the present embodiment, in the same manner as in the third embodiment, the control portion 119 determines that a sheet is passing when the photo sensor 33 is turned off, and determines that there is no sheet when the photo sensor 33 is turned on. FIG. 20A illustrates a state (non-detection state) in which the abutting portion 271*a* is located at the standby position so as to abut on the sheet S. In this state, the light blocking portion 272*a* does not shield the photo sensor 33 from light.

Figure 20B:
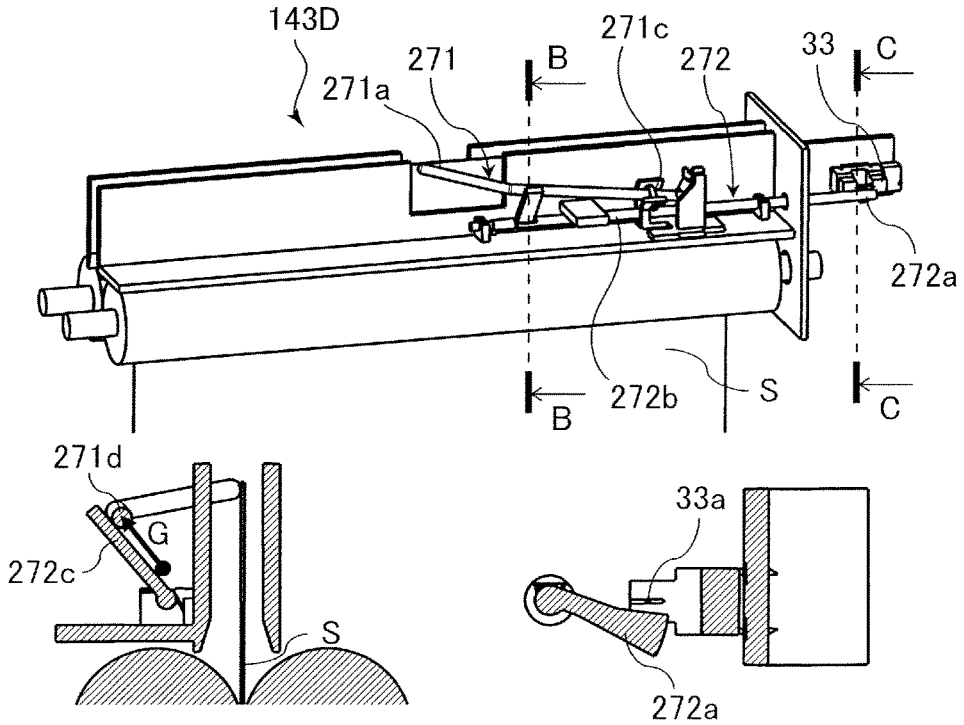
FIG. 20B shows a perspective view and a side view illustrating the sheet detection portion in a state in which the abutting portion is located at a second position.

In other words, the photo sensor 33 is turned on, and thus the control portion 119 determines that there is no sheet. If a sheet front end abuts on the abutting portion 271*a* which is thus pressed by the conveyed sheet S in this state, as illustrated in FIG. 20B, the pivotal member 271 is swung in a direction of an arrow G centering on the pivotal shaft 271*c* maintained at a position serving as a first moving center (the center of pivotal motion). The joint portion 271*d* of the pivotal member 271 is moved in the direction of the arrow G due to this swing, but an abutting surface of the joint portion 272*c* of the light blocking member 272 on the pivotal member 271 is a surface parallel to the width direction W orthogonal to the direction of the arrow G and the direction of sheet conveyance, and thus the joint portion 271*d* of the pivotal member 271 is just moved on the joint portion 272*c* of the light blocking member 272. Then, the light blocking member 272 is not rotated due to the swing of the pivotal member 271 in the direction of the arrow G.

As a result, in this situation, since the light blocking portion 272*a* is located at a position retracted from an optical axis area 33*a*, the photo sensor 33 is turned on, and thus the control portion 119 does not detect passage of a sheet. If the front end of the sheet S passes the abutting portion 271*a* of the pivotal member 271, the pressing to the abutting portion 271*a* from the sheet S is released. At this time, the abutting portion 271*a* is located at the second position.

Figure 21A:
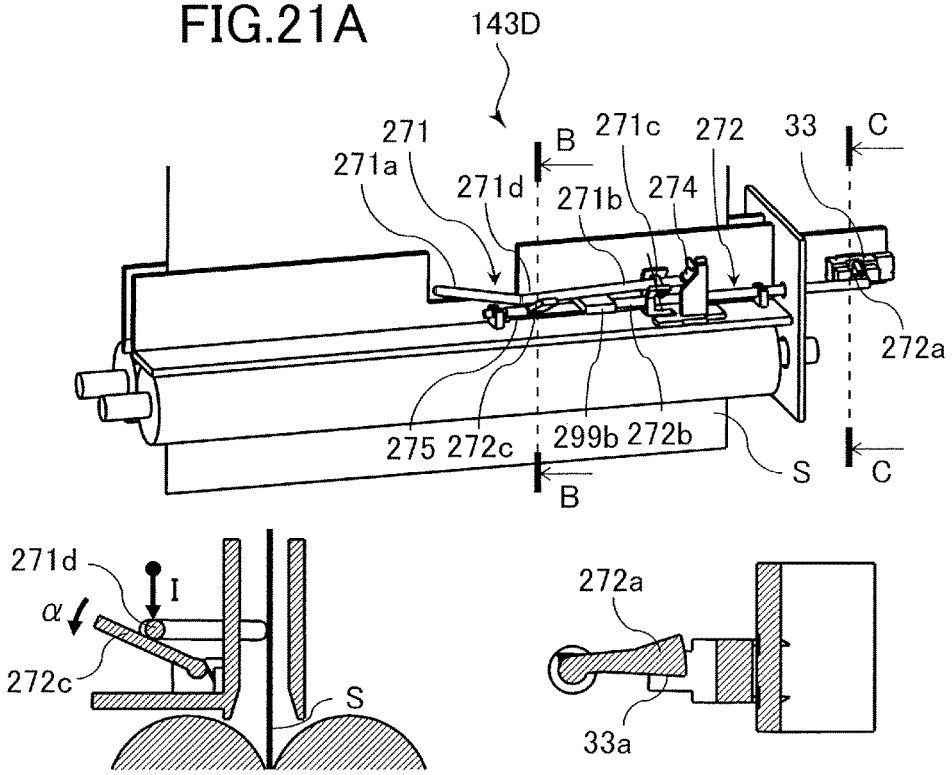
FIG. 21A shows a perspective view and a side view illustrating the sheet detection portion in a state in which the abutting portion is located at a third position.

Here, as illustrated in FIG. 19, hook shapes 271*e* and 273*a* are respectively formed at the arm 271*b* and the support portion 273, and a tensile spring 274 biasing the pivotal member 271 is hooked to the hook shapes 271*e* and 273*a*. An abutting rib 299*b* on which the arm 271*b* of the pivotal member 271 abuts is provided at the sheet guide 299. Consequently, as illustrated in FIG. 21A, the pivotal member 271 is swung by the tensile spring 274 in a direction of an arrow I centering on the pivotal shaft 271*c* in a state in which the tip of the abutting portion 271*a* is in contact with the sheet S, and abuts on the abutting rib 299*b* provided at the sheet guide 299 so as to be stopped. At this time, the abutting portion 271*a* is located at the third position.

Here, in the joint 276, a force causing the joint portion 271*d* of the pivotal member 271 to rotate the joint portion 272*c* of the light blocking member 272 in a direction of an arrow $\alpha$ centering on the rotation shaft 272*b* by pressing the joint portion 272*c* by using a force received from the tensile spring 274 is greater than a force causing the torsion spring 275 to rotate the light blocking member 272 in a $-\alpha$ direction. In this case, the light blocking portion 272*a* is rotated in the arrow $\alpha$ direction so as to enter the optical axis area 33*a* of the photo sensor 33. Consequently, the photo sensor 33 changes from an ON state to an OFF state, and thus the control portion 119 detects passage the sheet on the basis of a change in a signal from the photo sensor 33.

Figure 21B:
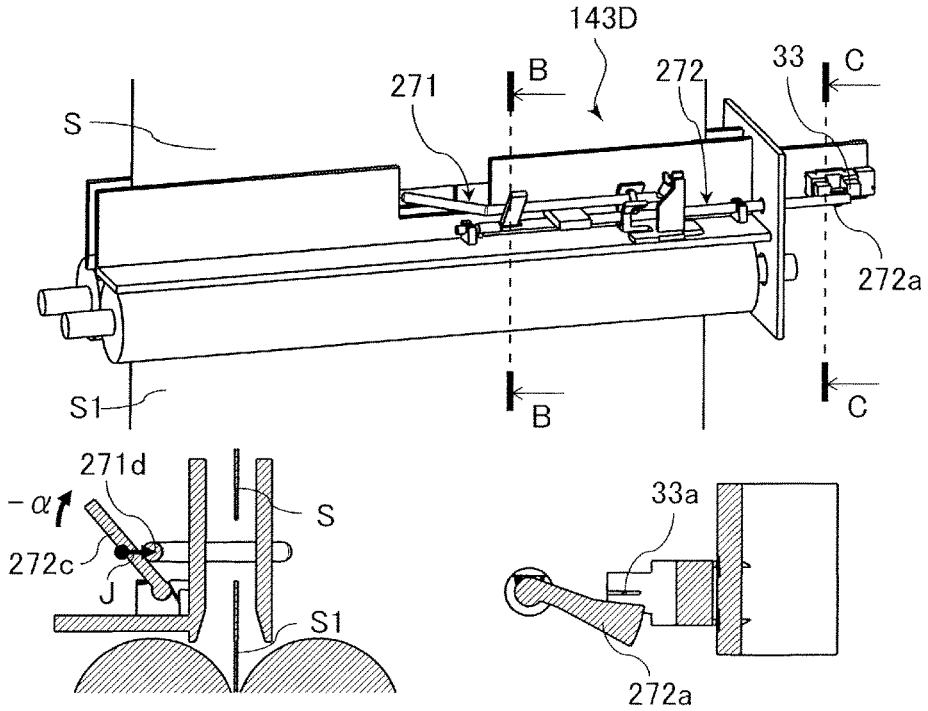
FIG. 21B shows a perspective view and a side view illustrating an operation in which the abutting portion returns from the third position to the standby position.

Thereafter, if the rear end of the sheet S passes the pivotal member 271, as illustrated in FIG. 21B, the pivotal member 271 is swung by the tensile spring 274 in the direction of the arrow J centering on the pivotal shaft 271*c*, and the light blocking member 272 is rotated by the torsion spring 275 in the $-\alpha$ direction centering on the rotation shaft 272*b* so as to return to the standby position. Due to the rotation of the light blocking member 272, the light blocking portion 272*a* is also rotated in the $-\alpha$ direction so as to be retracted from the optical axis area 33*a* of the photo sensor 33. Consequently, the photo sensor 33 changes from an OFF state to an ON state, and thus the control portion 119 detects that the rear end of the sheet S has passed on the basis of a change in a signal from the photo sensor 33.

As mentioned above, in the present embodiment, the photo sensor 33 is disposed on an opposite side to the fixing roller pair 96 with the side plate 280 interposed therebetween, and the abutting member 270 is constituted of two components such as the pivotal member 271 and the light blocking member 272. Consequently, an operation trajectory of the abutting member 270 during detection of a sheet is formed of only an operation trajectory of the pivotal member 271 within the sheet width, and an operation trajectory of the light blocking member 272 performing a rotation operation. Thus, an operation trajectory is reduced more than in a case where the abutting member is constituted of a single component, and, as a result, downsizing of the printer body is facilitated.

Since the rotation shaft 272*b* is parallel to the width direction W and is perpendicular to the side plate 280, a notch is sufficiently formed at the side plate 280 only by forming a hole penetrating through the rotation shaft 272*b*. Therefore, it becomes easier to reduce the atmospheric temperature around the photo sensor 33 to the heat resistant temperature or less of the photo sensor 33 than in a case where the abutting member is constituted of a single component in which case a notch of the side plate 280 is required to be large.

As described above, in the present embodiment, even in a case where the temperature around the sheet guide becomes higher than a heat resistant temperature of the photo sensor due to heat generated from the fixing roller pair, it is possible to achieve the same effect as in the third embodiment already described above. It is noted that, the technique of the present embodiment may be combined with the first to third embodiments.

It is noted that, in the first to fourth embodiments described hitherto, the full-color laser printer illustrated in FIG. 1 has been exemplified as an image forming apparatus including the sheet detection portion, but this disclosure is not limited thereto. For example, this disclosure is applicable to an image reading apparatus 200 including an image reading portion reading an image recorded on the sheet S as illustrated in FIG. 22.

Figure 22:
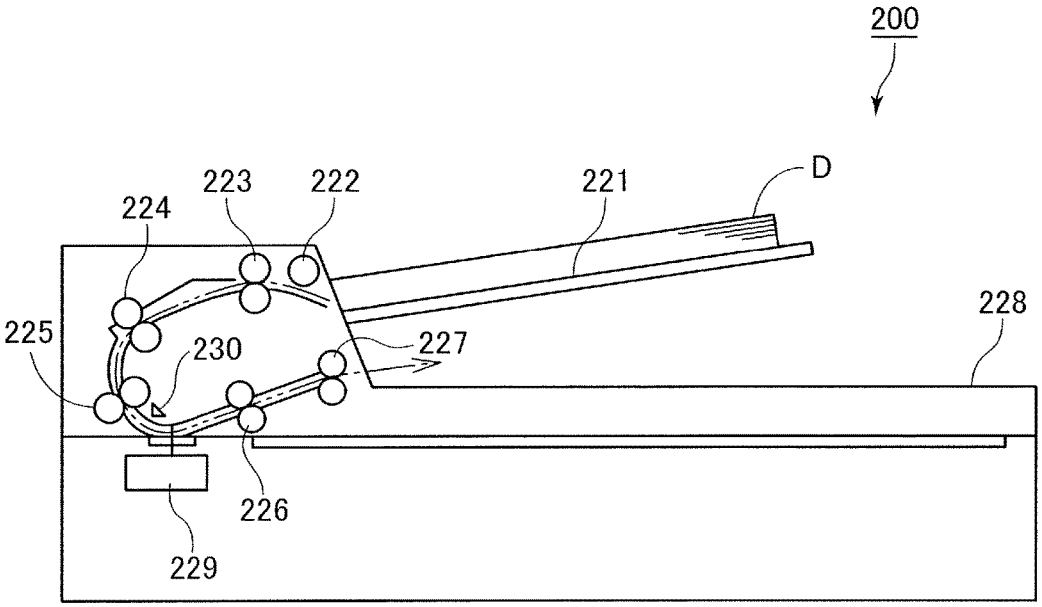
FIG. 22 is a side view illustrating an image reading apparatus provided with the sheet detection portion.

In FIG. 22, a document D set in a document tray 221 is fed by a feed roller 222. The fed document D is conveyed by document conveyance rollers 223, 224, 225 and 226 along a document conveyance path. A reading sensor 229 as an image reading portion reads the document D which is being conveyed by the document conveyance rollers 223, 224, 225 and 226, and the read document D is discharged from a document discharge roller 227 onto a document discharge tray 228. A sheet detection portion 230 having the same configuration as in the first to fourth embodiments is provided in the document conveyance path along which the document D is conveyed and detects the document D, and the reading sensor 229 starts reading of the document D according to a detection timing of the document D.

The abutting members 11, 60, 70 and 270 of the sheet detection portions detecting a front end and a rear end of a sheet have been described hitherto, but a configuration of this disclosure is not required to be limited to sheet detection. For example, this disclosure is applicable to an abutting member used for a skew correction unit correcting a skew during conveyance of a sheet, or a full load detection unit detecting a full load state of sheets stacked on a discharged sheet tray.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-003400, filed Jan. 9, 2015, and Japanese Patent Application No. 2015-236251, filed Dec. 3, 2015, which are hereby incorporated by reference herein in its entirety.

What is claimed is:

1. A sheet conveyance apparatus comprising:

a conveyance portion configured to convey a sheet in a sheet conveyance direction;

a moving member comprising a main body portion, a contact portion configured to come into contact with the sheet conveyed by the conveyance portion, and a shaft portion provided on the main body portion, the moving member being configured to be moved due to the contact portion contacting the sheet;

a first support portion configured to pivotably support a first part of the shaft portion such that the moving member is configured to pivot around the shaft portion;

a second support portion configured to pivotably and slidably support a second part of the shaft portion such that the second part of the shaft portion swings around the first part;

a biasing member configured to bias the moving member; and a sensor configured to transmit a signal according to a position of the moving member, wherein the moving member is configured to be moved so as to return, from a first position, to the first position through a second position and a third position from when a leading end of a single sheet contacts the contact portion until a trailing end of the single sheet leaves the contact portion, the first position being a position at which the contact portion protrudes inside a conveyance path of the sheet, the second position being a position to which the contact portion is moved downstream in the sheet conveyance direction and is moved in a direction of being retracted from the conveyance path from the first position, and the third position being a position to which the contact portion is moved upstream in the sheet conveyance direction from the second position, and wherein the shaft portion extends so as to incline with respect to the sheet conveyance direction such that the shaft portion is further downstream in the sheet conveyance direction as the shaft portion extends toward to the conveyance path.

2. The sheet conveyance apparatus according to claim 1, wherein the moving member pivots around the shaft portion in a first pivot direction in a case where the moving member moves from the first position to the second position, the moving member pivots around the shaft portion in a second pivot direction opposed to the first pivot direction with the second part of the shaft portion slidably moving along the second support portion in a first sliding direction in a case where the moving member moves from the second position to the third position, and the second part of the shaft portion slidably moves along the second support portion in a second sliding direction opposed to the first sliding direction in a case where the moving member moves from the third position to the first position.

3. The sheet conveyance apparatus according to claim 2, wherein the first and second sliding directions are orthogonal to the sheet conveyance direction.

4. The sheet conveyance apparatus according to claim 1, wherein the moving member moves from the first position to the second position due to the leading end of the sheet pressing the contact portion and passing through the contact portion, the moving member moves from the second position to the third position with the contact portion slidably contacting with a surface of the sheet by a biasing force of the biasing member, and the moving member moves from the third position to the first position by the biasing force of the biasing member in response to the trailing end of the sheet leaving the contact portion.

5. The sheet conveyance apparatus according to claim 1, wherein the main body portion extends in a width direction orthogonal to the sheet conveyance direction in a case where the moving member is positioned at the first position, and wherein the contact portion extends in a direction inclined with respect to the width direction in a case where the moving member is positioned at the first position.

6. The sheet conveyance apparatus according to claim 1, wherein the first support portion comprises a hole portion defining a hole and configured to pivotably support the first part of the shaft portion, the second support portion comprises a sliding surface configured to slidably support the second part of the shaft portion, and the sliding surface is longer than a diameter of the hole.

7. The sheet conveyance apparatus according to claim 6, wherein the second support portion is formed to be slit-shaped.

8. A sheet conveyance apparatus comprising:

a conveyance portion configured to convey a sheet in a sheet conveyance direction;

a moving member comprising a main body portion, a contact portion configured to come into contact with the sheet conveyed by the conveyance portion, and a shaft portion provided on the main body portion, the moving member being configured to be moved due to the contact portion contacting the sheet;

a first support portion configured to pivotably support a first part of the shaft portion such that the moving member is configured to pivot around the shaft portion;

a second support portion configured to pivotably and slidably support a second part of the shaft portion such that the second part of the shaft portion swings around the first part;

a biasing member configured to bias the moving member; and a sensor configured to transmit a signal according to a position of the moving member, wherein the moving member is configured to be moved so as to return, from a first position, to the first position through a second position and a third position from when a leading end of a single sheet contacts the contact portion until a trailing end of the single sheet leaves the contact portion, the first position being a position at which the contact portion protrudes inside a conveyance path of the sheet, the second position being a position to which the contact portion is moved downstream in the sheet conveyance direction and is moved in a direction of being retracted from the conveyance path from the first position, and the third position being a position to which the contact portion is moved upstream in the sheet conveyance direction from the second position, and wherein the shaft portion extends so as to incline with respect to the sheet conveyance direction such that the shaft portion is further downstream in the sheet conveyance direction as the shaft portion extends toward to the conveyance path, wherein a signal from the sensor in a case where the moving member is positioned at the first position is different from signals from the sensor in a case where the moving member is positioned at the second position and the third position.

* * * * *